US006967634B2

(12) United States Patent
Ota

(10) Patent No.: US 6,967,634 B2
(45) Date of Patent: Nov. 22, 2005

(54) DISPLAY DRIVER CIRCUIT, ELECTRO-OPTICAL DEVICE, AND DISPLAY DRIVE METHOD

(75) Inventor: Yusuke Ota, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 298 days.

(21) Appl. No.: 10/306,810

(22) Filed: Nov. 27, 2002

(65) Prior Publication Data

US 2003/0151583 A1 Aug. 14, 2003

(30) Foreign Application Priority Data

Dec. 5, 2001 (JP) ..... 2001-371470

(51) Int. Cl.[7] ..... G04G 3/36
(52) U.S. Cl. ..... 345/4 X; 345/99; 345/98
(58) Field of Search ..... 345/691, 87, 94, 345/95, 98, 99, 100, 211, 208

(56) References Cited

U.S. PATENT DOCUMENTS 6,154,189 A * 11/2000 Tamura et al. ..... 345/89

FOREIGN PATENT DOCUMENTS

JP 06-095078 4/1994
JP 08160390 A * 6/1996 ..... G02F 1/133
JP 09-080380 3/1997
JP 10-143120 5/1998
JP 10-301545 11/1998
JP 11-149278 6/1999
JP 11-258575 9/1999
JP 2000-258751 9/2000
JP 2001-109440 4/2001
JP 2001-236044 8/2001

* cited by examiner

*Primary Examiner*—Kent Chang
(74) *Attorney, Agent, or Firm*—Hogan & Hartson, LLP

(57) ABSTRACT

The present invention provides a display driver circuit having a simple configuration due to a decrease in the number of voltage levels and capable of preventing deterioration of contrast ratio in display drive by using MLS, an electro-optical device, and a display drive method. First to fourth bits of grayscale data corresponding to a display pattern for three lines are supplied to each ROM. The ROMs decode and output 4MLS operation results for a display pattern defined by the first to fourth bits of the grayscale data and a dummy display-pattern corresponding to the display pattern based on orthogonal functions defined by combinations of a scan pattern and a dummy scan pattern of a virtual electrode based on a field signal.

8 Claims, 22 Drawing Sheets

FIG. 5

RELATION BETWEEN FIELD AND COM WAVEFORM

| | FIELD 1 | FIELD 2 | FIELD 3 | FIELD 4 |
|---|---|---|---|---|
| F1 | H | H | L | L |
| F2 | H | L | H | L |
| LINE 1 | 1 | 1 | −1 | 1 |
| LINE 2 | −1 | 1 | 1 | 1 |
| LINE 3 | 1 | −1 | 1 | 1 |
| LINE 4 (DUMMY LINE) | 1 | 1 | 1 | −1 |

("1" CORRESPONDS TO VOLTAGE LEVEL V3,
"−1" CORRESPONDS TO VOLTAGE LEVEL MV3)

FIG. 6E

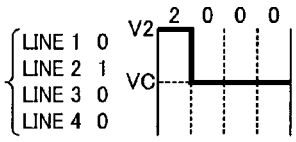

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| LINE 1 0 | 2 | 0 | 0 | 0 | LINE 1 Vy−2Vx | Vy | −Vy | Vy | $Voff^2$ |
| LINE 2 1 | | | | | LINE 2 −Vy−2Vx | Vy | Vy | Vy | $Von^2$ |
| LINE 3 0 | | | | | LINE 3 Vy−2Vx | −Vy | Vy | Vy | $Voff^2$ |
| LINE 4 0 | | | | | LINE 4 Vy−2Vx | Vy | Vy | −Vy | $Voff^2$ |

FIG. 6F

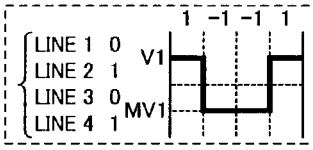

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| LINE 1 0 | 1 | −1 | −1 | 1 | LINE 1 Vy−Vx | Vy+Vx | −Vy+Vx | Vy−Vx | $Voff^2$ |
| LINE 2 1 | | | | | LINE 2 −Vy+Vx | Vy+Vx | Vy+Vx | Vy−Vx | $Von^2$ |
| LINE 3 0 | | | | | LINE 3 Vy−Vx | −Vy+Vx | Vy+Vx | Vy−Vx | $Voff^2$ |
| LINE 4 1 | | | | | LINE 4 Vy−Vx | Vy+Vx | Vy+Vx | −Vy−Vx | $Von^2$ |

FIG. 6G

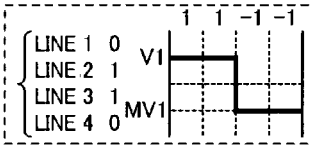

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| LINE 1 0 | 1 | 1 | −1 | −1 | LINE 1 Vy−Vx | Vy−Vx | −Vy+Vx | Vy+Vx | $Voff^2$ |
| LINE 2 1 | | | | | LINE 2 −Vy−Vx | Vy−Vx | Vy+Vx | Vy+Vx | $Von^2$ |
| LINE 3 1 | | | | | LINE 3 Vy−Vx | −Vy−Vx | Vy+Vx | Vy+Vx | $Von^2$ |
| LINE 4 0 | | | | | LINE 4 Vy−Vx | Vy−Vx | Vy+Vx | −Vy+Vx | $Voff^2$ |

FIG. 6H

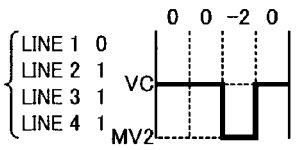

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| LINE 1 0 | 0 | 0 | −2 | 0 | LINE 1 Vy | Vy | −Vy+2Vx | Vy | $Voff^2$ |
| LINE 2 1 | | | | | LINE 2 −Vy | Vy | Vy+2Vx | Vy | $Von^2$ |
| LINE 3 1 | | | | | LINE 3 Vy | −Vy | Vy+2Vx | Vy | $Von^2$ |
| LINE 4 1 | | | | | LINE 4 Vy | Vy | Vy+2Vx | −Vy | $Von^2$ |

FIG. 8A

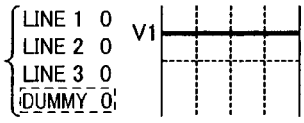

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| LINE 1 0 | | | | | LINE 1 Vy−Vx | Vy−Vx | −Vy−Vx | Vy−Vx | $Voff^2$ |
| LINE 2 0 | | | | | LINE 2 −Vy−Vx | Vy−Vx | Vy−Vx | Vy−Vx | $Voff^2$ |
| LINE 3 0 | | | | | LINE 3 Vy−Vx | −Vy−Vx | Vy−Vx | Vy−Vx | $Voff^2$ |
| DUMMY 0 | | | | | | | | | |

FIG. 8B

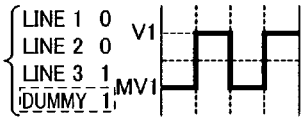

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| LINE 1 0 | | | | | LINE 1 Vy+Vx | Vy−Vx | −Vy+Vx | Vy−Vx | $Voff^2$ |
| LINE 2 0 | | | | | LINE 2 −Vy+Vx | Vy−Vx | Vy+Vx | Vy−Vx | $Voff^2$ |
| LINE 3 1 | | | | | LINE 3 Vy+Vx | −Vy−Vx | Vy+Vx | Vy−Vx | $Von^2$ |
| DUMMY 1 | | | | | | | | | |

FIG. 8C

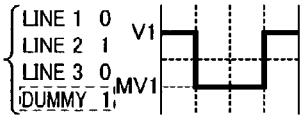

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| LINE 1 0 | | | | | LINE 1 Vy−Vx | Vy+Vx | −Vy+Vx | Vy−Vx | $Voff^2$ |
| LINE 2 1 | | | | | LINE 2 −Vy−Vx | Vy+Vx | Vy+Vx | Vy−Vx | $Von^2$ |
| LINE 3 0 | | | | | LINE 3 Vy−Vx | −Vy+Vx | Vy+Vx | Vy−Vx | $Voff^2$ |
| DUMMY 1 | | | | | | | | | |

FIG. 8D

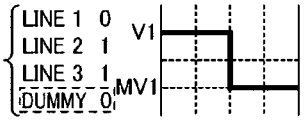

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| LINE 1 0 | | | | | LINE 1 Vy−Vx | Vy−Vx | −Vy+Vx | Vy+Vx | $Voff^2$ |
| LINE 2 1 | | | | | LINE 2 −Vy−Vx | Vy−Vx | Vy+Vx | Vy+Vx | $Von^2$ |
| LINE 3 1 | | | | | LINE 3 Vy−Vx | −Vy−Vx | Vy+Vx | Vy+Vx | $Von^2$ |
| DUMMY 0 | | | | | | | | | |

FIG. 8E

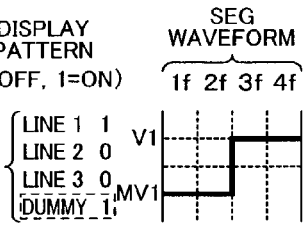

| VOLTAGE APPLIED TO LIQUID CRYSTAL LAYER | 1f | 2f | 3f | 4f | EVALUATION VALUE |
|---|---|---|---|---|---|
| LINE 1 | Vy+Vx | Vy+Vx | −Vy−Vx | Vy−Vx | $Von^2$ |
| LINE 2 | −Vy+Vx | Vy+Vx | Vy−Vx | Vy−Vx | $Voff^2$ |
| LINE 3 | Vy+Vx | −Vy+Vx | Vy−Vx | Vy−Vx | $Voff^2$ |

FIG. 8F

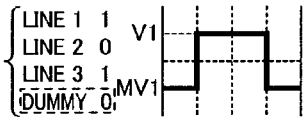

| VOLTAGE APPLIED TO LIQUID CRYSTAL LAYER | 1f | 2f | 3f | 4f | EVALUATION VALUE |
|---|---|---|---|---|---|
| LINE 1 | Vy+Vx | Vy−Vx | −Vy−Vx | Vy+Vx | $Von^2$ |
| LINE 2 | −Vy+Vx | Vy−Vx | Vy−Vx | Vy+Vx | $Voff^2$ |
| LINE 3 | Vy+Vx | −Vy−Vx | Vy−Vx | Vy+Vx | $Von^2$ |

FIG. 8G

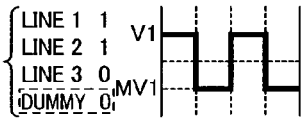

| VOLTAGE APPLIED TO LIQUID CRYSTAL LAYER | 1f | 2f | 3f | 4f | EVALUATION VALUE |
|---|---|---|---|---|---|
| LINE 1 | Vy−Vx | Vy+Vx | −Vy−Vx | Vy+Vx | $Von^2$ |
| LINE 2 | −Vy−Vx | Vy+Vx | Vy−Vx | Vy+Vx | $Von^2$ |
| LINE 3 | Vy−Vx | −Vy+Vx | Vy−Vx | Vy+Vx | $Voff^2$ |

FIG. 8H

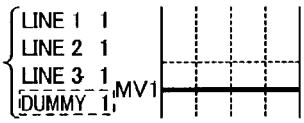

| VOLTAGE APPLIED TO LIQUID CRYSTAL LAYER | 1f | 2f | 3f | 4f | EVALUATION VALUE |
|---|---|---|---|---|---|
| LINE 1 | Vy+Vx | Vy+Vx | −Vy+Vx | Vy+Vx | $Von^2$ |
| LINE 2 | −Vy+Vx | Vy+Vx | Vy+Vx | Vy+Vx | $Von^2$ |
| LINE 3 | Vy+Vx | −Vy+Vx | Vy+Vx | Vy+Vx | $Von^2$ |

FIG. 9

RELATION BETWEEN DISPLAY PATTERN AND DUMMY PATTERN, AND MLS OPERATION RESULTS

400

| DISPLAY PATTERN ("-1" CORRESPONDS TO ON, "1" CORRESPONDS TO OFF) | | | | MLS OPERATION RESULTS ("2" CORRESPONDS TO VOLTAGE LEVEL V1, "-2" CORRESPONDS TO VOLTAGE LEVEL MV1) | | | |
|---|---|---|---|---|---|---|---|
| LINE 1 | LINE 2 | LINE 3 | DUMMY PATTERN | FIELD 1 | FIELD 2 | FIELD 3 | FIELD 4 |
| 1 | 1 | 1 | 1 | 2 | 2 | 2 | 2 |
| 1 | 1 | -1 | -1 | -2 | 2 | -2 | 2 |
| 1 | -1 | 1 | -1 | 2 | -2 | -2 | 2 |
| 1 | -1 | -1 | 1 | 2 | 2 | -2 | -2 |
| -1 | 1 | 1 | -1 | -2 | -2 | 2 | 2 |
| -1 | 1 | -1 | 1 | -2 | 2 | 2 | -2 |
| -1 | -1 | 1 | 1 | 2 | -2 | 2 | -2 |
| -1 | -1 | -1 | -1 | -2 | -2 | -2 | -2 |

410 402 412 404

FIG. 10

DECODE TRUTH TABLE OF 3-LINE MLS OPERATION RESULTS

| | D1 | D2 | D3 | OUT (H: VOLTAGE LEVEL V1 / L: VOLTAGE LEVEL MV1) |
|---|---|---|---|---|
| FIELD 1 (f1=「H」) | 0 | 0 | 0 | H |
| | 0 | 0 | 1 | L |
| | 0 | 1 | 0 | H |
| | 0 | 1 | 1 | H |
| | 1 | 0 | 0 | L |
| | 1 | 0 | 1 | L |
| | 1 | 1 | 0 | H |
| | 1 | 1 | 1 | L |
| FIELD 2 (f2=「H」) | 0 | 0 | 0 | H |
| | 0 | 0 | 1 | H |
| | 0 | 1 | 0 | L |
| | 0 | 1 | 1 | H |
| | 1 | 0 | 0 | L |
| | 1 | 0 | 1 | H |
| | 1 | 1 | 0 | L |
| | 1 | 1 | 1 | L |
| FIELD 3 (f3=「H」) | 0 | 0 | 0 | H |
| | 0 | 0 | 1 | L |
| | 0 | 1 | 0 | L |
| | 0 | 1 | 1 | L |
| | 1 | 0 | 0 | H |
| | 1 | 0 | 1 | H |
| | 1 | 1 | 0 | H |
| | 1 | 1 | 1 | L |
| FIELD 4 (f4=「H」) | 0 | 0 | 0 | H |
| | 0 | 0 | 1 | H |
| | 0 | 1 | 0 | H |
| | 0 | 1 | 1 | L |
| | 1 | 0 | 0 | H |
| | 1 | 0 | 1 | L |
| | 1 | 1 | 0 | L |
| | 1 | 1 | 1 | L |

("1" CORRESPONDS TO ON, "0" CORRESPONDS TO OFF)

DISPLAY DRIVER CIRCUIT, ELECTRO-OPTICAL DEVICE, AND DISPLAY DRIVE METHOD

Japanese Patent Application No. 2001-371470 filed on Dec. 5, 2001, is hereby incorporated by reference in its entirety.

BACKGROUND OF THE INVENTION

The present invention relates to a display driver circuit, an electro-optical device, and a display drive method.

In electro-optical devices having a simple matrix liquid crystal panel, an improvement in response time and contrast is realized by using a multi-line selection (MLS) in which a plurality of scan electrodes are simultaneously selected. In the case of performing grayscale display by using MLS, frame rate control (hereinafter abbreviated as "FRC"), pulse width modulation (hereinafter abbreviated as "PWM"), or the like has been employed.

However, FRC has a problem in which flicker significantly occurs when the frame frequency is low. Therefore, the frame frequency must be increased when performing grayscale display by using FRC. In recent years, an increase in demand for video display using a liquid crystal panel makes it necessary to use liquid crystal materials having a high response time. Liquid crystal materials having a high response time are suitable for video display because the ON/OFF switching speed of the liquid crystal is increased. However, these materials tend to cause the switching of the liquid crystal to be more obvious. Therefore, the frame frequency must be further increased, whereby power consumption is increased.

On the contrary, PWM does not have problems relating to occurrence of flicker. However, PWM has problems relating to the influence of crosstalk. Specifically, in the case of driving a liquid crystal panel by using MLS, a root-mean-square value is applied to a liquid crystal layer. The voltage level of a scan electrode is changed when the voltage level of a signal electrode is changed. This decreases the root-mean-square value, whereby contrast deteriorates. The influence of crosstalk can be reduced by contriving a drive waveform of the voltage applied to the signal electrode. For example, the influence of crosstalk can be reduced without changing the root-mean-square value by shifting the drive waveform (to the right or the left) in each line or each frame. Moreover, the influence of crosstalk can be reduced by decreasing a change in voltage level of the scan electrode caused by a change in voltage level of the signal electrode by decreasing the number of change points of the drive waveform.

BRIEF SUMMARY OF THE INVENTION

One aspect of the present invention relates to a display driver circuit which drives an electro-optical device having scan electrodes and signal electrodes by using a multi-line selection that selects three scan electrodes simultaneously, the display driver circuit comprising:

first to m-th (m is a natural number) decoder circuits which are provided for respective bits of each of first to third grayscale data and output decoded output signals based on a field signal and the respective bits of each of the first to third grayscale data, the first to third grayscale data being m-bit data and corresponding to a scan pattern of the three scan electrodes; and a signal electrode driver circuit which drives the signal electrode based on the decoded output signals output from the first to m-th decoder circuits, wherein the first to m-th decoder circuits output the decoded output signals corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes.

Another aspect of the present invention relates to a display driver circuit which drives an electro-optical device having scan electrodes and signal electrodes by using a multi-line selection that selects three scan electrodes simultaneously, the display driver circuit comprising:

a grayscale data conversion circuit which converts m (m is a natural number) bits of first to third grayscale data corresponding to scan pattern of the three scan electrodes into (m+p) bits (p is a natural number) of first to third converted grayscale data, respectively;

first to (m+p)th decoder circuits which are provided for respective bits of each of the first to third converted grayscale data and output decoded output signals based on a field signal and respective bits of each of the first to third converted grayscale data; and a signal electrode driver circuit which drives the signal electrode based on the decoded output signals output from the first to (m+p)th decoder circuits, wherein the first to (m+p)th decoder circuits output the decoded output signals corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes.

BRIEF DESCRIPTION OF THE SEVERAL VIEWS OF THE DRAWING

FIG. 5 shows the relation between a field and a common waveform;

FIGS. 6A to 6H show segment waveforms, voltage applied to a liquid crystal layer, and an evaluation value in the case of MLS selecting four lines simultaneously;

FIGS. 8A to 8H show segment waveforms, voltage applied to a liquid crystal layer, and an evaluation value in the case of MLS selecting three lines in this embodiment;

FIG. 9 shows a relationship between a display pattern and MLS operation results in this embodiment;

FIG. 10 shows an example of a truth table of the MLS decoder in this embodiment;

DETAILED DESCRIPTION OF THE EMBODIMENT

Embodiments of the present invention are described below.

Note that the embodiments described hereunder do not in any way limit the scope of the invention defined by the claims laid out herein. Note also that all of the elements of these embodiments should not be taken as essential requirements to the means of the present invention.

Figure 18:
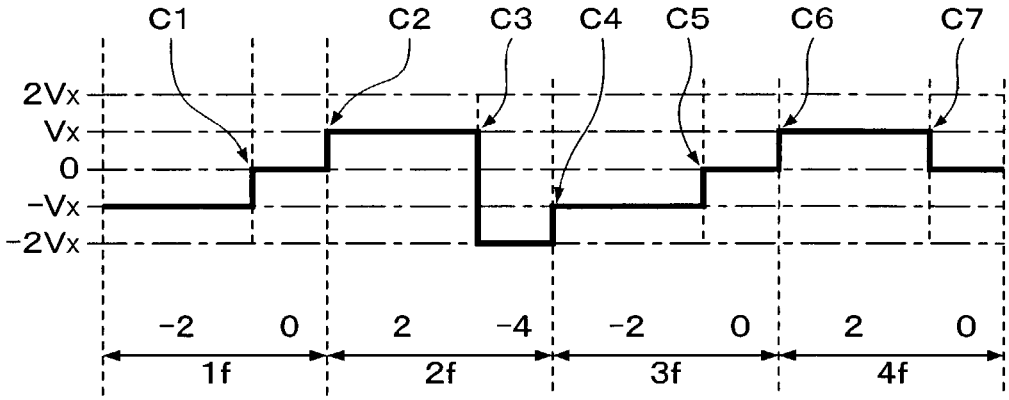
FIG. 18 is a waveform diagram showing an example of a segment waveform in the case of MLS selecting 4 lines simultaneously.

In the case of MLS that selects four scan electrodes simultaneously (4MLS), the number of voltage levels applied to a signal electrode is five (2Vx, Vx, 0, −Vx, −2Vx) as shown in FIG. 18, for example. Therefore, a drive waveform of voltage applied to the signal electrode becomes very complicated. Specifically, a circuit which shifts the drive waveform is complicated and the number of change points (C1 to C7) of the voltage levels increases. The drive waveform can be simplified and the number of change points of voltage can be decreased by decreasing the number of voltage levels. However, a decrease in the number of voltage levels causes deterioration of contrast ratio. For example, the number of voltage levels is four in the case of MLS that selects three scan electrodes simultaneously (3MLS). However, the contrast ratio is decreased in 3MLS in comparison with 4MLS.

As a drive method for realizing a decrease in the number of voltage levels while preventing a decrease in contrast ratio, a drive method utilizing a virtual electrode has been proposed (Japanese Patent Application Laid-open No. 10-301545, for example). However, this technology requires a complicated operation circuit which performs MLS operations for generating virtual data from grayscale data.

According to the embodiments described below, a display driver circuit having a simple configuration due to a decrease in the number of voltage levels and capable of preventing deterioration of contrast ratio in MLS display drive, an electro-optical device, and a display drive method can be provided.

One embodiment of the present invention relates to a display driver circuit which drives an electro-optical device having scan electrodes and signal electrodes by using a multi-line selection that selects three scan electrodes simultaneously, the display driver circuit comprising:

first to m-th (m is a natural number) decoder circuits which are provided for respective bits of each of first to third grayscale data and output decoded output signals based on a field signal and the respective bits of each of the first to third grayscale data, the first to third grayscale data being m-bit data and corresponding to a scan pattern of the three scan electrodes; and a signal electrode driver circuit which drives the signal electrode based on the decoded output signals output from the first to m-th decoder circuits, wherein the first to m-th decoder circuits output the decoded output signals corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes.

In this embodiment, the first to m-th decoder circuits are provided for respective bits of m bits of the grayscale data. Each bit of the first to third grayscale data corresponding to the three scan electrodes is input to corresponding one of the first to m-th decoder circuits. Specifically, the k-th ($1 \leqq k \leqq m$, k is a natural number) bit of each of the first to third grayscale data is input to the k-th decoder circuit.

The first to m-th decoder circuits output the decoded output signals corresponding to the field signal by using the results of a given operation executed on the display pattern and the dummy pattern corresponding to the display pattern based on the orthogonal functions (defined by the scan pattern of the three scan electrodes in each field and the scan pattern of the virtual scan electrode corresponding to the scan pattern of the scan electrodes).

According to this embodiment, only two voltage levels can be used in 3MLS by using the scan pattern of the virtual electrode and the dummy pattern. This enables a simple drive waveform to be generated by decreasing the number of change points of the voltage levels of the signal electrode, whereby MLS can be realized by using an extremely simple configuration. Moreover, since the signal electrode can be driven by the first to m-th decoder circuits in 3MLS by using 4MLS operation results, a decrease in contrast due to a decrease in the number of electrodes can be prevented. Furthermore, since it is unnecessary to determine by operations the dummy scan pattern corresponding to the scan pattern of the scan electrodes and the dummy pattern corresponding to the display pattern, the configuration can be simplified.

The first to m-th decoder circuits may output the decoded output signals corresponding to the field by determining the MLS operation results in each field in advance by using the orthogonal functions, and storing the MLS operation results in ROMs or forming a logic circuit using a combinational circuit, for example.

The dummy pattern corresponding to the display pattern may be determined so that the number of displayed state and non-displayed state of the display pattern and the dummy pattern is an even number (including 0), for example.

The display driver circuit according to this embodiment may comprise a modulated pulse width signal conversion circuit which modulates pulse width of m bits of the decoded output signals output from the first to m-th decoder circuits, and the signal electrode driver circuit may drive the signal electrode based on signals, pulse width of which is modulated by the modulated pulse width signal conversion circuit.

According to this embodiment, since the drive waveform is simplified due to a decrease in the number of change points of voltage levels of the signal electrode, the influence of crosstalk accompanied by pulse width modulation can be reduced. Therefore, in the case of performing grayscale display by using MLS, low power consumption and high contrast grayscale display can be realized by using PWM instead of FRC.

Another embodiment of the present invention relates to a display driver circuit which drives an electro-optical device having scan electrodes and signal electrodes by using a multi-line selection that selects three scan electrodes simultaneously, the display driver circuit comprising:

a grayscale data conversion circuit which converts m (m is a natural number) bits of first to third grayscale data corresponding to scan pattern of the three scan electrodes into (m+p) bits (p is a natural number) of first to third converted grayscale data, respectively;

first to (m+p) th decoder circuits which are provided for respective bits of each of the first to third converted grayscale data and output decoded output signals based on a field signal and respective bits of each of the first to third converted grayscale data; and a signal electrode driver circuit which drives the signal electrode based on the decoded output signals output from the first to (m+p)th decoder circuits, wherein the first to (m+p) th decoder circuits output the decoded output signals corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes.

In this embodiment, the grayscale data conversion circuit which converts m bits of grayscale data into (m+p) bits of grayscale data is provided. Grayscale data of which the number of bits is changed by the grayscale data conversion circuit is input to the first to (m+p)th decoder circuits. The first to (m+p) th decoder circuits are provided for respective bits of (m+p) bits of the grayscale data. Each bit of the first to third grayscale data corresponding to the three scan electrodes is input to corresponding one of the first to (m+p)th decoder circuits. Specifically, the j-th ($1 \leqq j \leqq (m+p)$, j is a natural number) bit of each of the first to third grayscale data are input to the j-th decoder circuit.

The first to (m+p)th decoder circuits output the decoded output signals corresponding to the field signal by using the results of a given operation executed on the display pattern and the dummy pattern corresponding to the display pattern based on the orthogonal functions (defined by the scan pattern of the three scan electrodes in each field and the scan pattern of the virtual scan electrode corresponding to the scan pattern of the scan electrodes).

According to this embodiment, since the number of bits can be changed by the grayscale data conversion circuit, the grayscale display can be set more minutely. Moreover, a grayscale display suitable for properties of the eyes of the viewer of the display panel can be achieved by allowing the grayscale data conversion circuit to switch specific grayscale data to corrected grayscale data and output the corrected grayscale data, for example.

Since the number of voltage levels can be decreased in 3MLS by using the scan pattern of the virtual electrode and the dummy pattern, MLS can be realized by using an extremely simple configuration. Since the signal electrode can be driven by the first to (m+p)th decoder circuits in 3MLS by using the MLS operation results which enable contrast to be improved in comparison with 3MLS, a decrease in contrast can be prevented. Since it is unnecessary to determine by operations the dummy scan pattern corresponding to the scan pattern of the scan electrodes and the dummy pattern corresponding to the display pattern, the configuration can be simplified.

The first to (m+p)th decoder circuits may output the decoded output signals corresponding to the field by determining the MLS operation results in each field in advance by using the orthogonal functions, and storing the MLS operation results in ROMs or forming a logic circuit using a combinational circuit, for example.

The dummy pattern corresponding to the display pattern may be determined so that the number of displayed state and non-displayed state of the display pattern and the dummy pattern is an even number (including 0), for example.

The display driver circuit according to this embodiment may comprise a modulated pulse width signal conversion circuit which modulates pulse width of (m+p) bits of the decoded output signals output from the first to (m+p)th decoder circuits, and the signal electrode driver circuit may drive the signal electrode based on signals, pulse width of which is modulated by the modulated pulse width signal conversion circuit.

According to this embodiment, since the drive waveform is simplified due to a decrease in the number of change points of the voltage levels of the signal electrode, the influence of crosstalk accompanied by pulse width modulation can be reduced. Therefore, in the case of performing grayscale display by using MLS, low power consumption and high contrast grayscale display can be realized by using PWM instead of FRC. Moreover, since the number of bits of the grayscale data is changed, grayscale characteristics which can optionally be adjusted can be realized.

Still another embodiment of the present invention relates to an electro-optical device which is driven by using a multi-line selection that selects three scan electrodes simultaneously, the electro-optical device comprising:

a pixel defined by one of a plurality of scan electrodes and one of a plurality of signal electrodes intersecting each other;

the above display driver circuit which drives the signal electrode; and a scan driver which drives the scan electrodes.

According to this embodiment, an electro-optical device capable of preventing deterioration of a contrast ratio and having a simple configuration due to a decrease in the number of voltage levels can be provided.

A further embodiment of the present invention relates to an electro-optical device which is driven by using a multi-line selection that selects three scan electrodes simultaneously, the electro-optical device comprising:

a display panel having a pixel defined by one of a plurality of scan electrodes and one of a plurality of signal electrodes intersecting each other;

the above display driver circuit which drives the signal electrode; and a scan driver which drives the scan electrodes.

According to this embodiment, an electro-optical device capable of preventing deterioration of a contrast ratio and having a simple configuration due to a decrease in the number of voltage levels can be provided.

A still further embodiment of the present invention relates to a display drive method of driving an electro-optical device having scan electrodes and signal electrodes by using a multi-line selection that selects three scan electrodes simultaneously, the method comprising:

outputting decoded output signals for respective bits of each of first to third grayscale data, based on a field signal and the respective bits of each of the first to third grayscale data, the first to third grayscale data being m-bit (m is a natural number) data and corresponding to a scan pattern of the three scan electrodes; and driving the signal electrode based on the decoded output signals, wherein the decoded output signals are output corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes.

In this embodiment, the decoded output signals corresponding to the field signal are output for respective bits of each of the first to third grayscale data corresponding to the three scan electrodes by using the results of a given operation executed on the display pattern and the dummy pattern corresponding to the display pattern based on the orthogonal functions (prescribed by the scan patterns of the three scan electrodes in each field and the scan pattern of the virtual scan electrode corresponding to the scan patterns of the scan electrodes), and the signal electrode is driven based on the decoded output signals.

According to this embodiment, only two voltage levels can be used in 3MLS by using the scan pattern of the virtual electrode and the dummy pattern. This enables a simple drive waveform to be generated by decreasing the number of change points of the voltage levels of the signal electrode, whereby MLS can be realized by using an extremely simple configuration. Since the decoded output signals are output for respective bits of the grayscale data by using the 4MLS operation results in 3MLS, and the signal electrode is driven based on the decoded output signals, a decrease in contrast due to a decrease in the number of the electrodes can be prevented. Since it is unnecessary to determine by operations the dummy scan pattern corresponding to the scan pattern of the scan electrodes and the dummy pattern corresponding to the display pattern, the configuration can be simplified.

The dummy pattern corresponding to the display pattern may be determined so that the number of displayed state and non-displayed state of the display pattern and the dummy pattern is an even number (including 0), for example.

A yet further embodiment of the present invention relates to a display drive method of driving an electro-optical device having scan electrodes and signal electrodes by using a multi-line selection that selects three scan electrodes simultaneously, the method comprising:

converting m (m is a natural number) bits of first to third grayscale data corresponding to scan pattern of the three scan electrodes into (m+p) bits (p is a natural number) of first to third converted grayscale data, respectively;

outputting decoded output signals for respective bits of each of the first to third converted grayscale data, based on a field signal and respective bits of each of the first to third converted grayscale data; and driving the signal electrode based on the decoded output signals, wherein the decoded output signals are output corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes.

In this embodiment, m bits of grayscale data corresponding to the scan pattern of the three scan electrodes are converted into (m+p) bits of grayscale data, and the decoded output signals corresponding to the field signal are output for respective bit of each of the (m+p)-bit grayscale data by using the results of a given operation executed on the display pattern and the dummy pattern corresponding to the display pattern based on the orthogonal functions (prescribed by the scan patterns of the three scan electrodes in each field and the scan pattern of the virtual scan electrode corresponding to the scan patterns of the scan electrodes).

This enables the number of bits of the grayscale data to be changed, whereby the grayscale display can be set more minutely. Moreover, a grayscale display suitable for properties of the eyes of the viewer of the display panel can be achieved by allowing specific grayscale data to be switched to corrected grayscale data and the corrected grayscale data to be output, for example.

Since the number of voltage levels can be decreased in 3MLS by using the scan pattern of the virtual electrode and the dummy pattern, MLS can be realized by using an extremely simple configuration. Since the signal electrode can be driven in 3MLS by using the MLS operation results which enable contrast to be improved in comparison with 3MLS, a decrease in contrast can be prevented.

The dummy pattern corresponding to the display pattern may be determined so that the number of displayed state and non-displayed state of the display pattern and the dummy pattern is an even number (including 0), for example.

In the display drive method according to this embodiment, the signal electrode may be driven based on signals obtained by modulating pulse width of the decoded output signals.

According to this embodiment, since the drive waveform is simplified due to a decrease in the number of change points of the voltage levels of the signal electrode, the influence of crosstalk accompanied by pulse width modulation can be reduced. Therefore, in the case of performing grayscale display by using MLS, low power consumption and a high contrast grayscale display can realized by using PWM instead of FRC. Moreover, since the number of bits of the grayscale data is changed, grayscale characteristics which may optionally be adjusted can be realized.

The display driver circuit according to the embodiment of the present invention may have a configuration as described below.

Specifically, the display driver circuit according to the embodiment of the present invention may be a display driver circuit which drives an electro-optical device having scan electrodes and signal electrodes by using a multi-line selection in which n (n is a natural number) scan electrodes are simultaneously selected, comprising first to m-th (m is a natural number) decoder circuits which are provided for respective bits of m bits of first to n-th grayscale data corresponding to a scan pattern of the n scan electrodes and output decoded output signals based on each bit of the first to n-th grayscale data and a field signal, and a signal electrode driver circuit which drives the signal electrode based on the decoded output signals output from the first to m-th decoder circuits, wherein the first to m-th decoder circuits output the decoded output signals corresponding to the field signal by using results of a given operation executed on a display pattern and a dummy pattern corresponding to the display pattern based on orthogonal functions which define the scan pattern of the n scan electrodes in each field and a scan pattern of a virtual scan electrode corresponding to the scan pattern of the scan electrodes.

In this case, the first to m-th decoder circuits are provided for respective bits of m bits of the grayscale data. Each bit of the first to n-th grayscale data corresponding to the n scan electrodes is input to the first to m-th decoder circuits. Specifically, the k-th ($1 \leqq k \leqq m$, k is a natural number) bits of the first to n-th grayscale data are input to the k-th decoder circuit.

The first to m-th decoder circuits output the decoded output signals corresponding to the field signal by using the results of a given operation executed on the display pattern and the dummy pattern corresponding to the display pattern based on the orthogonal functions (prescribed by the scan pattern of the three scan electrodes in each field and the scan pattern of the virtual scan electrode corresponding to the scan pattern of the scan electrodes).

This enables the number of voltage levels to be decreased in MLS in which n lines are simultaneously selected (n-line MLS) by using the scan pattern of the virtual electrode and the dummy pattern, whereby MLS can be realized by using an extremely simple configuration. Since the signal electrode can be driven by the first to m-th decoder circuits in n-line MLS by using the MLS operation results which enable contrast to be improved in comparison with n-line MLS, a decrease in contrast can be prevented. Since it is unnecessary to determine by operations the dummy scan pattern corresponding to the scan pattern of the simultaneously selected scan electrodes and the dummy pattern corresponding to the display pattern, the configuration can be simplified.

The first to m-th decoder circuits may output the decoded output signal corresponding to the field by determining the MLS operation results in each field in advance by using the orthogonal functions, and storing the MLS operation results in ROMs or forming a logic circuit using a combinational circuit, for example.

The dummy pattern corresponding to the display pattern may be determined so that the number of displayed state and non-displayed state of the display pattern and the dummy pattern is an even number (including 0), for example.

The display drive method according to the embodiment of the present invention may have the following configuration.

Specifically, the display drive method according to the embodiment of the present invention may be a display drive method which drives an electro-optical device having scan electrodes and signal electrodes by using a multi-line selection in which n (n is a natural number) scan electrodes are simultaneously selected, the method including outputting decoded output signals for respective bits of each of m-bit first to n-th grayscale data (m is a natural number) corresponding to a scan pattern of the simultaneously selected n scan electrodes based on each bit of the first to n-th grayscale data and a field signal, and driving the signal electrode based on the decoded output signals, wherein the decoded output signals are output corresponding to the field signal by using results of a given operation executed on a display pattern and a dummy pattern corresponding to the display pattern based on orthogonal functions which define the scan pattern of the simultaneously selected n scan electrodes in each field and a scan pattern of a virtual scan electrode corresponding to the scan pattern of the scan electrodes.

In this case, the decoded output signals corresponding to the field signal are output for respective bits of each of the first to n-th grayscale data corresponding to the n scan electrodes by using the results of a given operation executed on the display pattern and the dummy pattern corresponding to the display pattern based on the orthogonal functions (prescribed by the scan patterns of the n scan electrodes in each field and the scan pattern of the virtual scan electrode corresponding to the scan patterns of the scan electrodes), and the signal electrode is driven based on the decoded output signals.

This enables the number of voltage levels to be decreased in n-line MLS by using the scan pattern of the virtual electrode and the dummy pattern. Therefore, a simple drive waveform is generated by decreasing the number of change points of the voltage levels of the signal electrode, whereby MLS can be realized by using an extremely simple configuration. Since the decoded output signals are output in n-line MLS in respective bits of the grayscale data by using the MLS operation results which enables contrast to be improved in comparison with the n-line MLS, and the signal electrode is driven based on the decoded output signals, a decrease in contrast due to a decrease in the number of the simultaneously selected scan electrodes can be prevented. Since it is unnecessary to determine by operations the dummy scan pattern corresponding to the scan pattern of the simultaneously selected scan electrodes and the dummy pattern corresponding to the display pattern, the configuration can be simplified.

The dummy pattern corresponding to the display pattern may be determined so that the number of displayed state and non-displayed state of the display pattern and the dummy pattern is an even number (including 0), for example.

These embodiments of the present invention are described below in detail with reference to the drawings.

1. Electro-Optical Device

Figure 1:
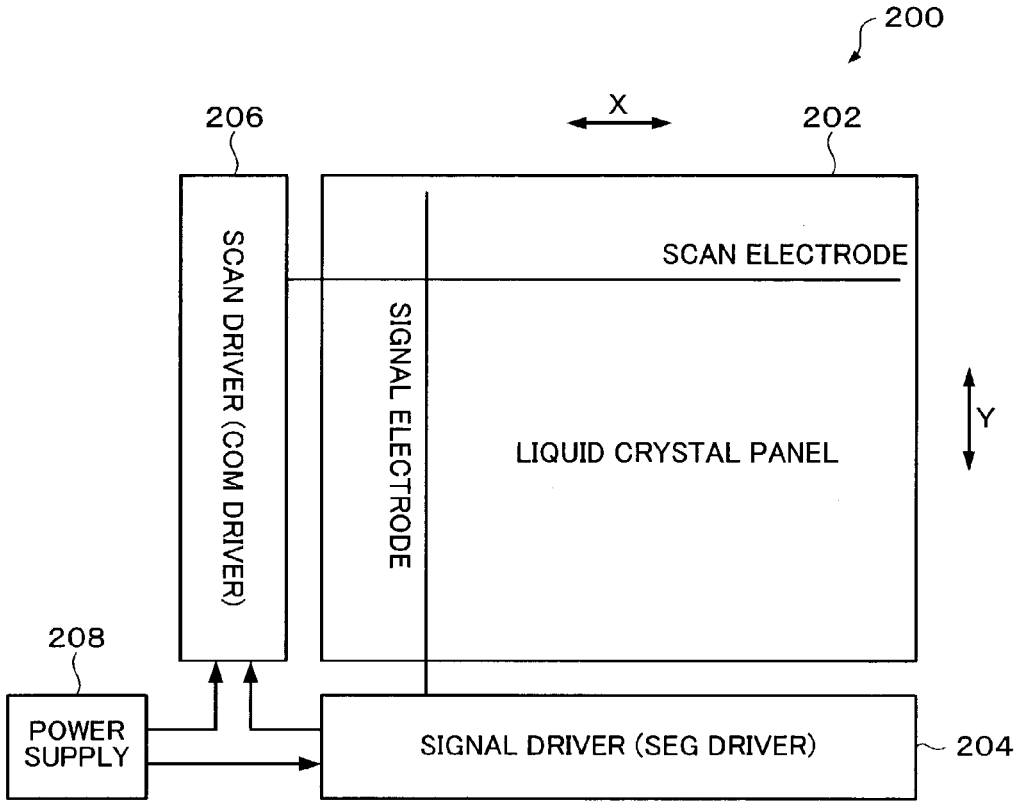
FIG. 1 is a block diagram showing an example of a configuration of an electro-optical device of this embodiment.

FIG. 1 shows an example of a configuration of an electro-optical device of these embodiments of the present invention.

An electro-optical device 200 includes a liquid crystal panel (display panel in a broad sense) 202.

The electro-optical device 200 may include a signal driver (segment driver) 204 which drives the liquid crystal panel 202. The electro-optical device 200 may include a scan driver (common driver) 206 which drives the liquid crystal panel 202.

The liquid crystal panel 202 has a plurality of pixels. Each pixel is defined by using one of a plurality of scan electrodes and one of a plurality of signal electrodes. An electro-optical element is provided in regions corresponding to the pixel. There are no specific limitations to the liquid crystal panel 202 insofar as the liquid crystal panel 202 utilizes an electro-optical element such as a liquid crystal of which the optical characteristics are changed by application of voltage. The liquid crystal panel 202 may be a simple matrix panel, for example. In this case, a liquid crystal is sealed between a first substrate on which a plurality of signal (segment) electrodes (first electrodes) are formed and a second substrate on which a plurality of scan (common) electrodes (second electrodes) are formed. A plurality of the signal electrodes are arranged on the first substrate in a direction X. A plurality of the scan electrodes are arranged on the second substrate in a direction Y. A plurality of the signal electrodes are driven by the signal driver 204. A plurality of the scan electrodes are driven by the scan driver 206.

The liquid crystal panel 202 may be mounted on a glass substrate, and the signal driver 204 and the scan driver 206 may be provided on the glass substrate.

The electro-optical device 200 may include a power supply circuit 208 which supplies voltage to the signal driver 204 and the scan driver 206. The power supply circuit 208 may be provided outside the electro-optical device 200, or inside the signal driver 204 or the scan driver 206.

The liquid crystal panel 202 is driven by using a multi-line selection (MLS) in which a plurality of scan electrodes are simultaneously selected. In the case where the number of simultaneously selected scan electrodes is m (m is a natural number; m=4, for example), the scan driver scans the scan electrodes in units of m scan electrodes. The signal driver outputs voltage having a segment waveform (signal electrode drive waveform, SEG waveform) based on display patterns in units of n (n is a natural number; n=4 when m=4, for example) to the signal electrode. The segment waveform is defined by MLS operation results obtained by the matrix operations on the display patterns by using orthogonal functions corresponding to the scan pattern of the scan electrodes.

In the case of m-line MLS, the number of voltage levels necessary for driving the scan electrodes is three, and the number of voltage levels necessary for driving the signal electrode is (m+1). In this case, three values of voltage levels necessary for driving the scan electrodes and (m+1) values of voltage levels necessary for driving the signal electrode are generated by the power supply circuit, and respectively supplied to the scan driver and the signal driver. In this embodiment, in order to decrease the number of voltage levels in the signal driver as much as possible, 3MLS is driven by using two values of voltage levels and contrast equal to 4MLS is realized by using a concept of a virtual electrode. In more detail, the signal driver in this embodiment outputs operation results for three lines obtained by the same operations as in 4MLS by using a dummy scan pattern of the virtual electrode corresponding to the scan pattern of the simultaneously selected three scan electrodes and a dummy display pattern (dummy pattern) corresponding to the display pattern based on the scan pattern to the signal electrode.

In this embodiment, the circuit configuration can be significantly simplified by allowing the MLS operation results obtained in advance to be decoded and output without performing complicated 4MLS operations each time the electrodes are driven. In more detail, the MLS operations are performed in advance on the display patterns for three lines and the dummy display pattern corresponding to the display patterns for three lines by using orthogonal functions defined by the combination of the scan pattern for the three scan electrodes and the dummy scan pattern corresponding to the scan pattern. Decoder circuits are provided for decoding and outputting the MLS operation results corresponding to a field signal. This enables the decoder circuits to be provided for each bit of grayscale data, thereby eliminating the need for a conventional complicated MLS operation circuit.

2. Display Driver Circuit

An MLS decoder (decoder circuit in a broad sense) which decodes and outputs the 4MLS operation results by using the scan pattern for simultaneously selected three lines and the display patterns for three lines corresponding to the scan pattern is described below. The MLS decoder is included in a display driver circuit.

2.1 MLS Decoder

Figure 2:
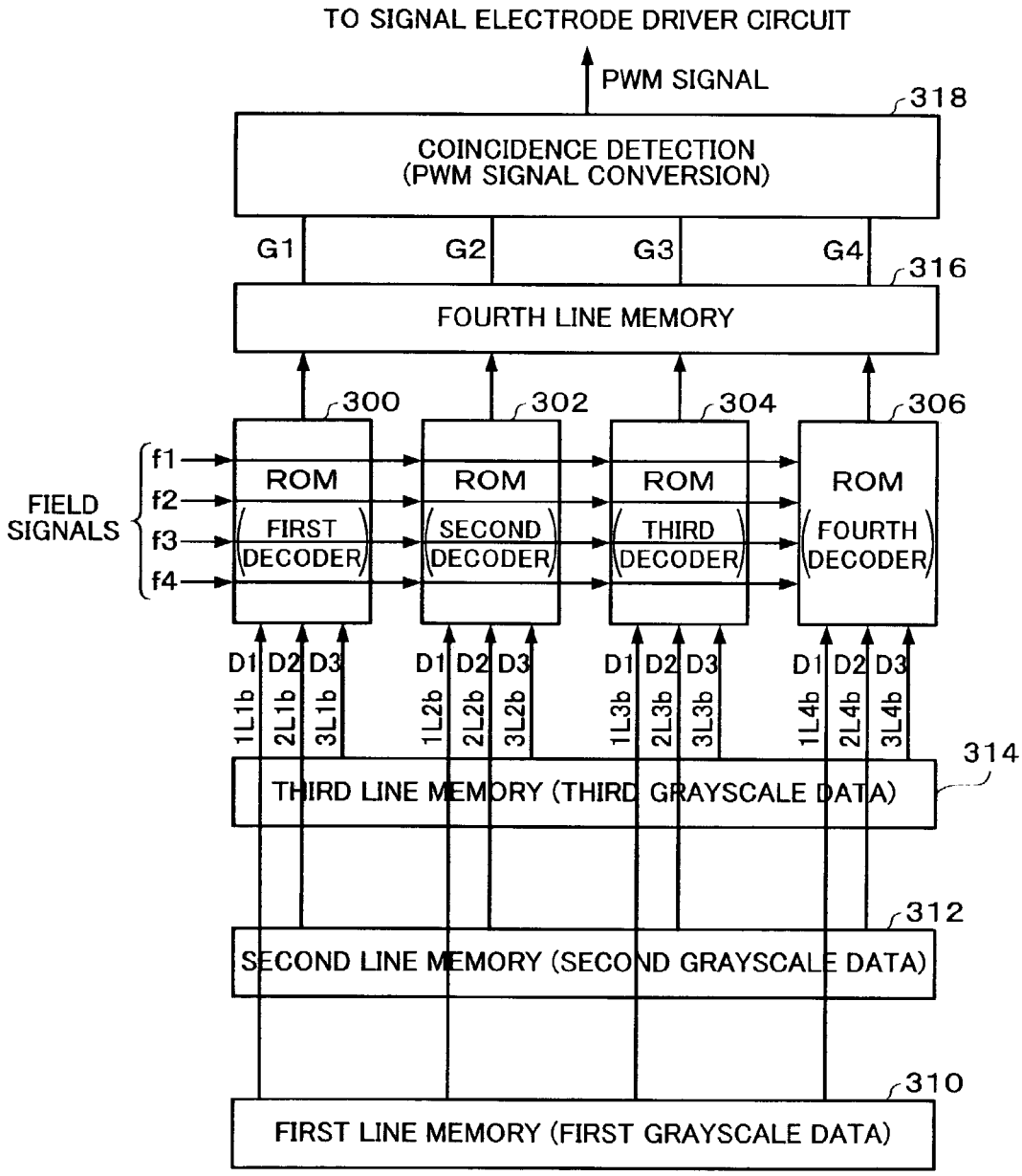
FIG. 2 is a block diagram showing a feature of a configuration of a display driver circuit including an MLS decoder in the case where grayscale data is four bits.

FIG. 2 shows a feature of a configuration of a display driver circuit including the MLS decoder.

The display driver circuit shown in FIG. 2 functions as a signal driver which drives the signal electrodes. FIG. 2 shows a configuration of a unit of one signal electrode (segment). The following description is given on the assumption that the number of bits m of grayscale data is four ($2^4$=16 grayscales).

The MLS decoder may be formed by using one or more read only memories (hereinafter abbreviated as "ROMs") provided for each bit of the grayscale data. In the case where the grayscale data is four bits, the MLS decoder may be formed by using four ROMs.

The display driver circuit includes ROMs (first to fourth (m-th) decoder circuits in a broad sense) 300, 302, 304, and 306 as the MLS decoders for respective bits of the grayscale data. A display pattern corresponding to the scan pattern of the simultaneously selected three scan electrodes is supplied to the ROMS 300, 302, 304, and 306 in bit units. Therefore, the k-th ($1 \leqq k \leqq m$, k is a natural number) bits of the grayscale data for three lines corresponding to the scan pattern of the simultaneously selected three scan electrodes are input to the k-th decoder circuit. Specifically, if the 4-bit grayscale data consists of the first to fourth bits, the first bits (three bits consisting of 1L1*b* to 3L1*b*) of the grayscale data corresponding to the display pattern for three lines are supplied to the ROM 300. The second bits (three bits consisting of 1L2*b* to 3L2*b*) of the grayscale data corresponding to the display pattern for three lines are supplied to the ROM 302. The third bits (three bits consisting of 1L3*b* to 3L3*b*) of the grayscale data corresponding to the display pattern for three lines are supplied to the ROM 304. The fourth bits (three bits consisting of 1L4*b*to 3L4*b*) of the grayscale data corresponding to the display pattern for three lines are supplied to the ROM 306. The ROMs 300, 302, 304, and 306 output two values of signals (decoded output signals) in response to field signals f1 to f4 by using the MLS operation results determined in field units.

The display driver circuit may include first to third line memories 310, 312, and 314 which hold the grayscale data for each signal electrode corresponding to the scan pattern of simultaneously selected scan electrodes. In this case, the first line memory 310 supplies each bit of first grayscale data held therein to the ROMs 300, 302, 304, and 306. The second and third line memories 312 and 314 supply each bit of second and third grayscale data respectively held therein to the ROMs 300, 302, 304, and 306. In the case where the display driver circuit includes a display data RAM which stores the grayscale data, the display data RAM may be allowed to have the same functions as the first to third line memories 310, 312, and 314.

The display driver circuit may include a fourth line memory 316 which holds the decoded results output from the ROMs 300, 302, 304, and 306 in bit units.

The MLS operation results decoded and output from the ROMs 300, 302, 304, and 306 are pulse width modulated and output to the signal electrode. In FIG. 2, the MLS operation results decoded and output from the ROMs 300, 302, 304, and 306 are latched by the fourth line memory 316 and pulse width modulated by a coincidence detection circuit (pulse width modulated (PWM) signal conversion circuit in a broad sense) 318.

The coincidence detection circuit 318 changes a signal level of coincidence detection results based on the coincidence detection results between a count value which is counted by a clock for pulse width clocking and the decoded and output MLS operation results and outputs the signal as a PWM signal.

The PWM signal is output to the signal electrode by a signal electrode driver circuit (not shown) provided for each signal electrode.

Figure 3:
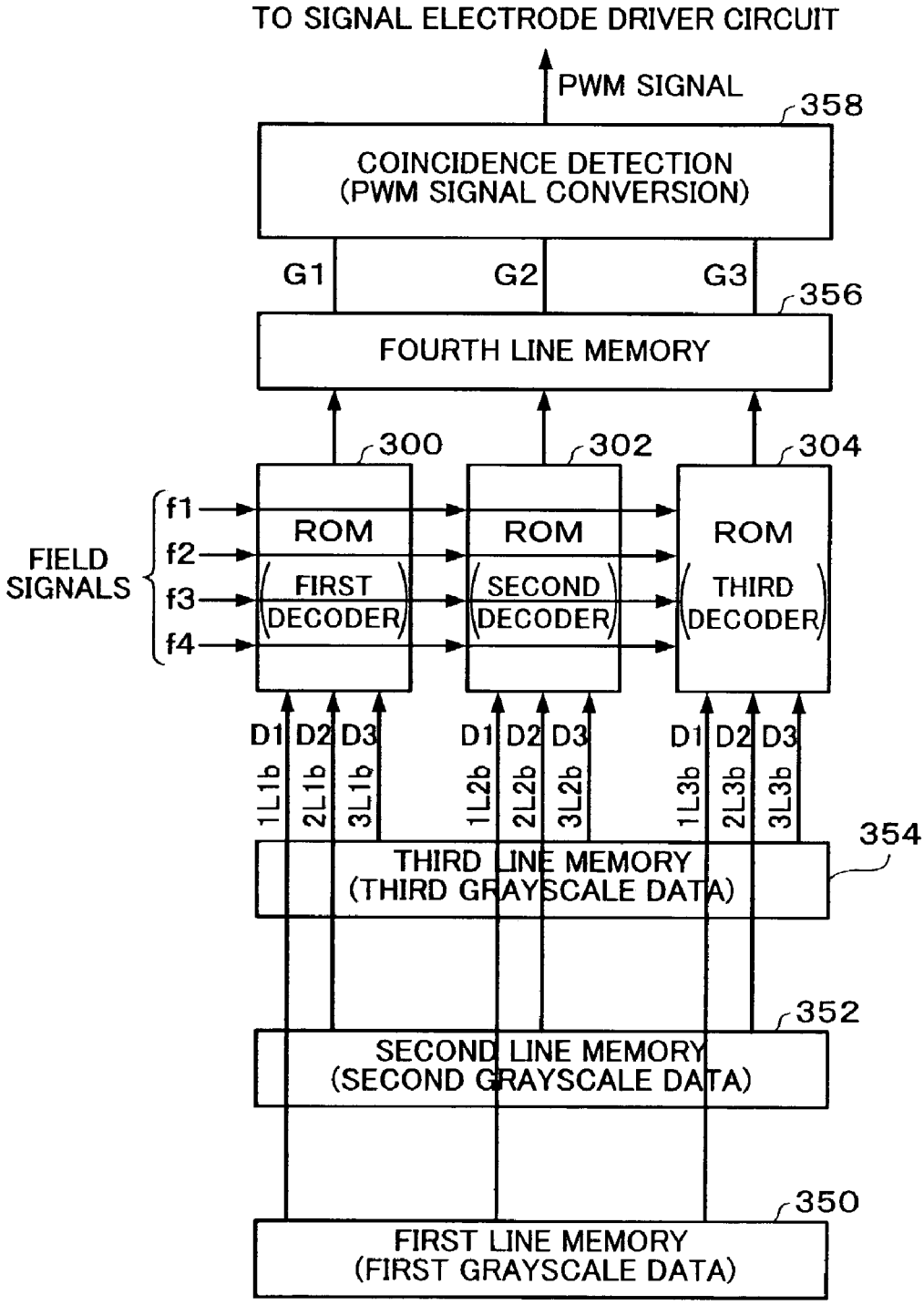
FIG. 3 is a block diagram showing a feature of a configuration of a display driver circuit including an MLS decoder in the case where grayscale data is three bits.

Since it suffices that the ROMs be provided as the decoder circuits for respective bits of the grayscale data, the display driver circuit has a configuration shown in FIG. 3 in the case where the grayscale data is three bits. Therefore, the technical range disclosed by this embodiment is not limited by the number of bits of the grayscale data.

Details of the MLS decoder included in the display driver circuit are described below.

2.1.1 3MLS

In this embodiment, using the scan pattern of the simultaneously selected three scan electrodes, the 4MLS operation results for the scan pattern of four scan electrodes by employing a concept of a dummy scan electrode (virtual electrode), is output to the signal electrode.

Figure 4:
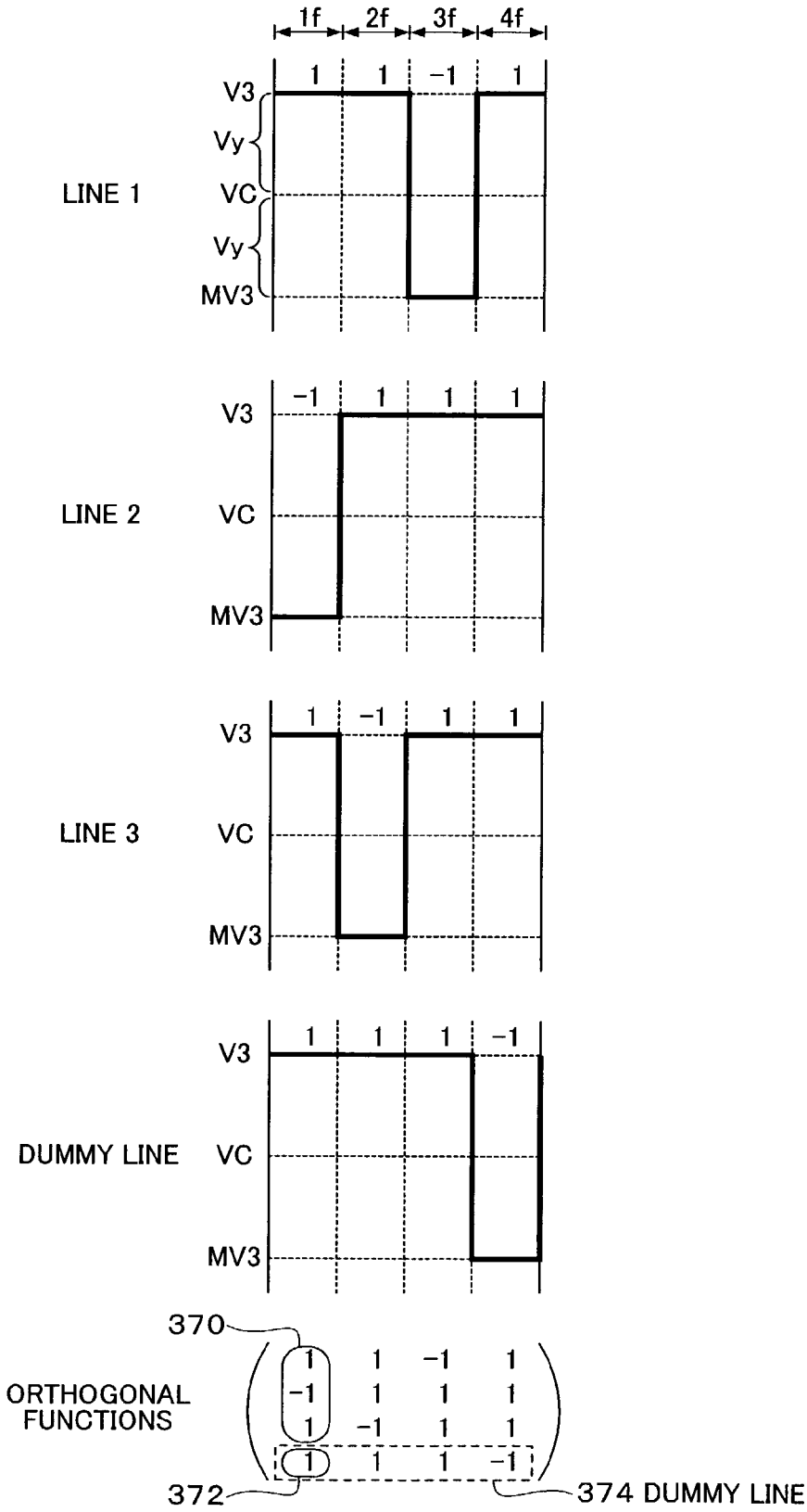
FIG. 4 is a waveform diagram showing an example of a scan pattern output to scan electrodes.

FIG. 4 shows an example of the scan patterns output to the scan electrodes.

In FIG. 4, the scan patterns output to the simultaneously selected three scan electrodes are illustrated in each field as common waveforms (scan electrode drive waveforms, COM waveforms). The scan driver outputs one of voltage levels V3 (=VC+Vy) and MV3 (=VC−Vy) having the same amplitude (=Vy) and different polarities based on a center voltage level VC to the scan electrodes in each field.

The voltage level V3 is referred to as "1", and the voltage level MV3 is referred to as "−1". In the case where the simultaneously selected scan electrodes is "−1" in one of 1*f* (field) to 3*f*, the scan pattern is prescribed so that the dummy scan electrode (dummy line) becomes "−1" in 4*f*.

As shown in FIG. 5, the scan driver is capable of outputting each scan pattern shown in FIG. 4 to the scan electrodes by supplying the voltage level V3 corresponding to "1" or the voltage level MV3 corresponding to "−1" to each scan electrode based on the field signals f1 to f4 corresponding to four states expressed by two bits of field setting signals F1 and F2.

The scan patterns supplied to the simultaneously selected three scan electrodes may be expressed as quartic orthogonal functions as shown in FIG. 4 by allowing the scan patterns in 1*f* to 4*f* in each line to make up components in each row. The orthogonal functions are prescribed in each field by a scan pattern 370 of the three scan electrodes and a scan pattern 372 of the virtual scan electrode (dummy line) corresponding to the scan pattern 370. Therefore, a scan pattern 374 of the dummy scan electrode is expressed in the fourth row. The orthogonal functions can be expressed in the same manner in the case where the number of simultaneously selected scan electrodes is n.

The segment waveforms in the case of 4MLS by using such scan patterns are described below.

FIGS. 6A to 6H and FIGS. 7A to 7H schematically show the segment waveforms in the case of 4MLS.

The segment waveforms are illustrated for all the display patterns corresponding to the above scan patterns.

In the case of 4MLS, the number of voltage levels necessary for driving the signal electrode is generally five. The voltage levels in each field are indicated by "−2", "−1", "0", "1", and "2". The voltage levels are referred to as V2, V1, VC, MV1, and MV2. The voltage level VC which can be shared between the signal driver and the scan driver is referred to as "0", the voltage level V2 as "2", the voltage level V1 as "1", the voltage level MV2 as "−1", and the voltage level MV2 as "−2". The five values of voltage levels V2, V1, VC, MV1, and MV2 satisfy the following relational equations.

$$V2=VC+2Vx \quad (1)$$

$$V1=VC+Vx \quad (2)$$

$$MV1=VC-Vx \quad (3)$$

$$MV2=VC-2Vx \quad (4)$$

Voltage applied to a liquid crystal layer in each line and each field is illustrated for each display pattern. The voltage applied to the liquid crystal layer is the difference between the voltage level of the scan electrode and the voltage level of the signal electrode. In the case of a display pattern (0,0,1,1) shown in FIG. 6D, since the scan electrode is at the voltage level V3 in 1*f* in the first line as shown in FIG. 4 and the signal electrode is at the voltage level MV1, the voltage applied to the liquid crystal layer is (V3−MV1) (=VC+Vy−(VC−Vx)=Vy+Vx). Similarly, since the scan electrode is at the voltage level V3 and the signal electrode is at the voltage level V1 in 2*f* in the first line, the voltage applied to the liquid crystal layer is Vy−Vx. In the case of a display pattern (1,1,0,1) shown in FIG. 7F, the voltage applied to the liquid crystal layer is VC in 1*f* in the first line. The voltage applied to the liquid crystal layer is Vy+2Vx in 2*f* in the first line.

Evaluation values corresponding to the root-mean-square values of the voltage applied to the liquid crystal layer in each line are shown in FIGS. 6A to 6H and FIGS. 7A to 7H taking only the selected period into consideration. These evaluation values are the sum of the squares of the applied voltages in each field. As a result, the evaluation values consist of two values expressed by $Voff^2$ or $Von^2$.

Figure 6A:
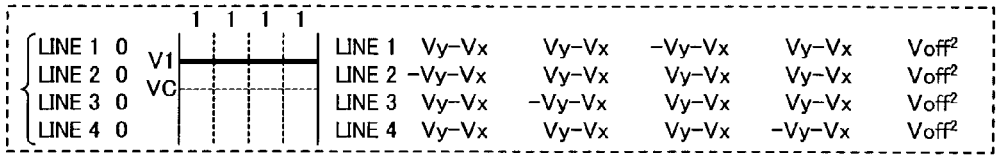
Figure 6B:
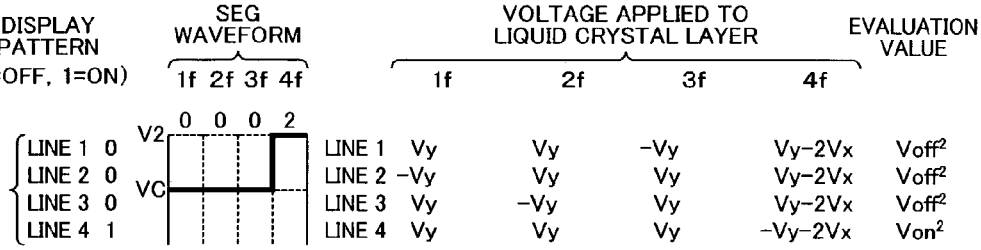
Figure 6C:
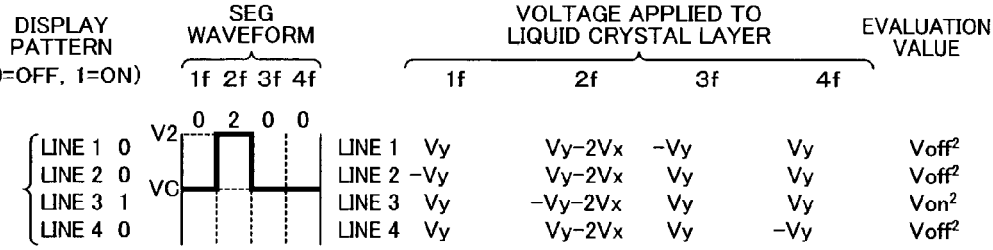
Figure 6D:
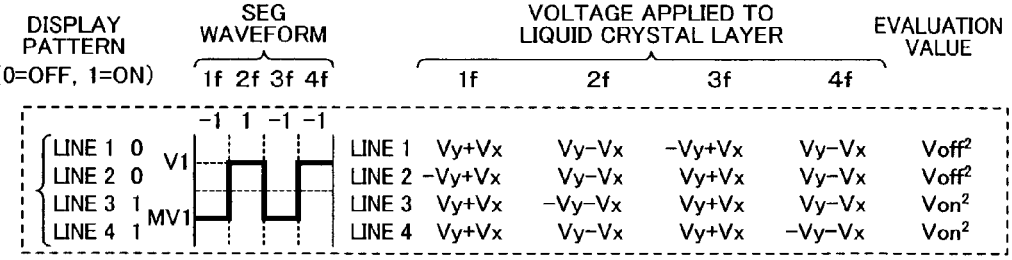
Figure 7A:
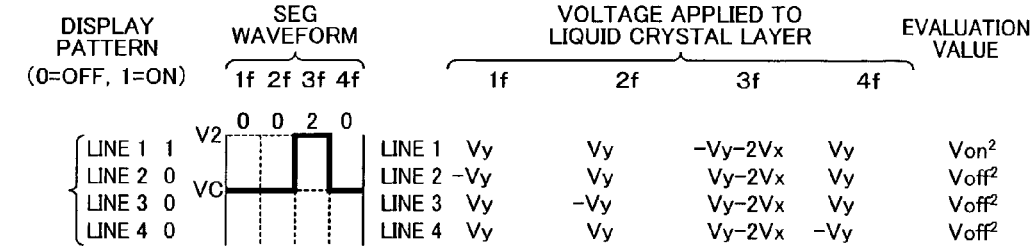
FIGS. 7A to 7H show segment waveforms, voltage applied to a liquid crystal layer, and an evaluation value in the case of MLS selecting four lines simultaneously.
Figure 7B:
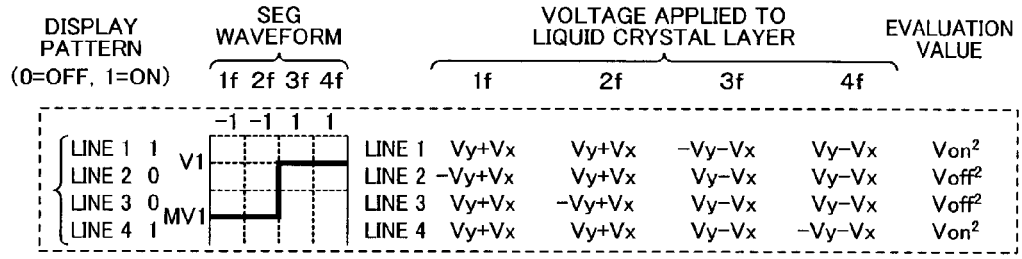
Figure 7C:
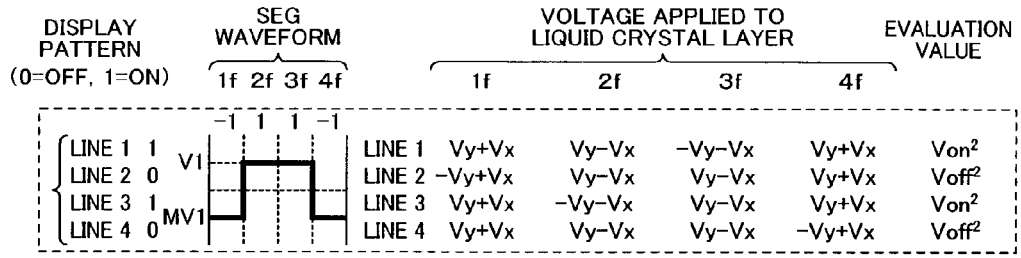
Figure 7D:
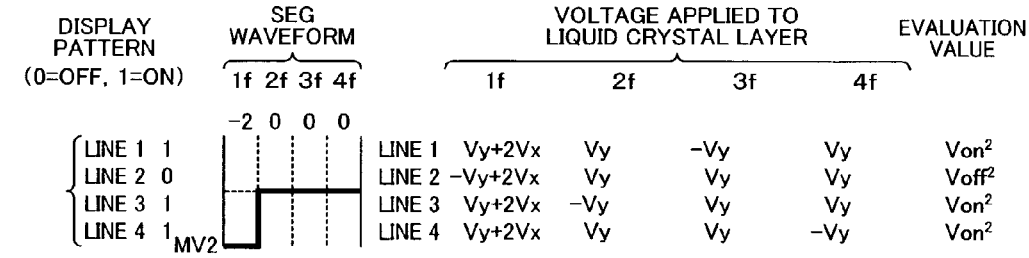
Figure 7E:
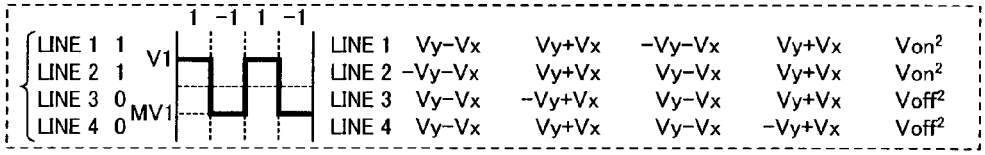
Figure 7F:
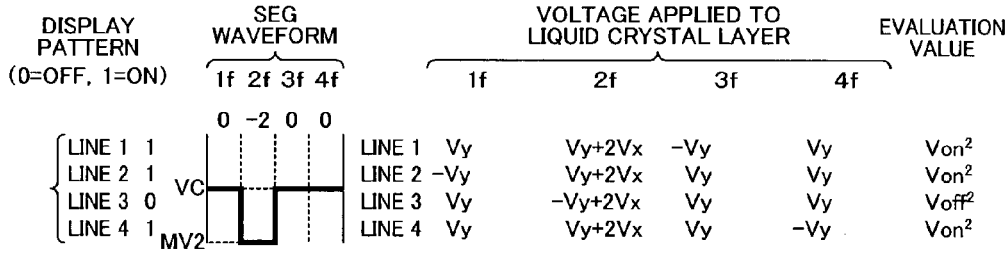
Figure 7G:
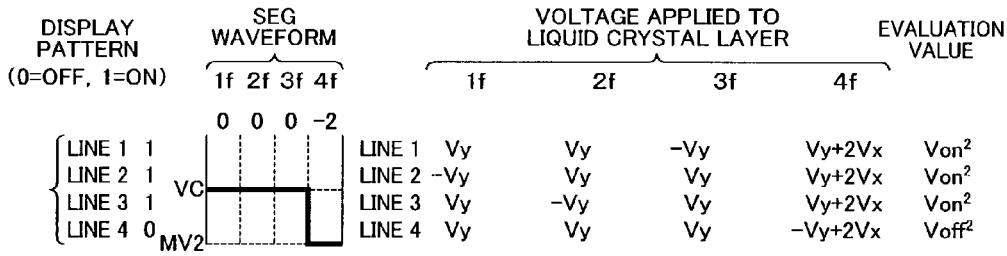
Figure 7H:
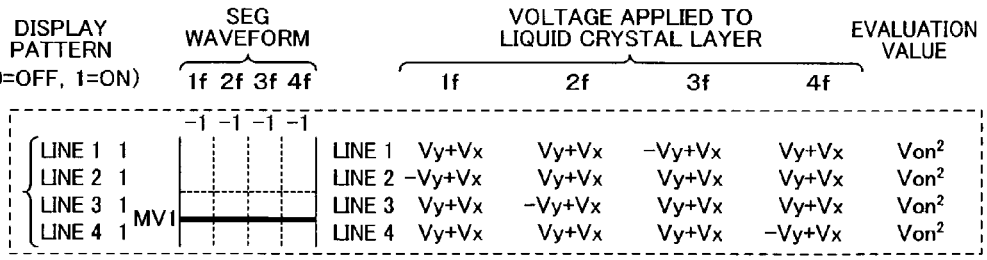

As shown in FIGS. 6A to 6H and FIGS. 7A to 7H, each two display patterns have the same pattern in the first line to the third line. For example, the first line to the third line of the display pattern shown in FIG. 6A are the same as the first line to the third line of the display pattern shown in FIG. 6B. This also applies to the display patterns shown in FIG. 6C and FIG. 6D, FIG. 6E and FIG. 6F, . . . , FIG. 7A and FIG. 7B, and FIG. 7G and FIG. 7H. For example, the evaluation values in the first line to the third line are the same in FIG. 6A and FIG. 6B, but only the evaluation values in the fourth line differ. This also applies to the display patterns shown in FIG. 6C and FIG. 6D, FIG. 6E and FIG. 6F, . . . , FIG. 7A and FIG. 7B, . . . and FIG. 7G and FIG. 7H.

In one of the display patterns in each combination, the segment waveform uses only two values of the voltage levels V1 and MV1. Specifically, these display patterns consist of (0,0,0,0) (FIG. 6A), (0,0,1,1) (FIG. 6D), (0,1,0,1) (FIG. 6F), (0,1,1,0) (FIG. 6G), (1,0,0,1) (FIG. 7B), (1,0,1,0) (FIG. 7C), (1,1,0,0) (FIG. 7E), and (1,1,1,1) (FIG. 7H) (eight patterns in total). Therefore, contrast equal to 4MLS can be realized in the first line to the third line by using these eight patterns. Moreover, the voltage level of the segment waveform corresponding to each display pattern can be expressed by two values.

2.1.2 Decode

FIGS. 8A to 8H schematically show the segment waveforms by using 3MLS in this embodiment.

Each display pattern is the segment waveforms selected from the segment waveforms shown in FIGS. 6A to 6H and FIGS. 7A to 7H as described above.

In the case of outputting these segment waveforms by using 3MLS, the display pattern in the fourth line corresponding to the display patterns in the first line to the third line is determined as the dummy display pattern (dummy pattern). In FIGS. 8A to 8H, the dummy pattern is selected so that the number of "1" of the display patterns in each line is an even number (0, 2, or 4).

The MLS operation results corresponding to the segment waveforms in which the voltage levels consist of two values as shown in FIGS. 8A to 8H can be obtained by the MLS operations on the display patterns for four lines in the same manner as in 4MLS using the orthogonal functions shown in FIG. 4. Therefore, contrast equal to 4MLS can be realized by outputting the voltage level V1 or MV1 in each field using the resulting MLS operation results.

FIG. 9 shows a relation between the display pattern and the MLS operation results in this embodiment.

ON and OFF of the display pattern respectively correspond to "−1" and "1". Either "1" or "−1" is selected as the dummy pattern so that the number of "1" or "−1" is an even number (0, 2, or 4).

As shown in FIG. 9, each display pattern by 4MLS can be covered by only using the eight patterns shown in FIGS. 8A to 8H. Therefore, the 4MLS operation results can be obtained by the MLS operations on each display pattern shown in FIG. 9. For example, "−1" is selected as a dummy pattern 402 corresponding to a display pattern 400 so that the number of "1" or "−1" of each element of the display pattern 400 and the dummy pattern 402 is an even number (0, 2, or 4). MLS operation results (given operation results) 404 are obtained by matrix operations (MLS operations, given operations) on the display pattern 400 and the dummy pattern 402 based on the orthogonal functions shown in FIG. 4. The MLS operation results 404 are the 4MLS operation results and either "2" or "−2" is obtained in each field. The segment waveform shown in FIG. 8B can be expressed by associating "2" and "−2" with the voltage levels V1 and MV1, respectively.

Therefore, a truth table described below can be obtained for the MLS decoder which decodes and outputs in each field.

FIG. 10 shows an example of a truth table of the MLS decoder in this embodiment.

"1" and "0" in the display patterns D1 to D3 respectively correspond to ON and OFF. A decoded output OUT is at the voltage level V1 when "H" and at the voltage level MV1 when "L". 1*f* is defined by allowing the field signal f1 to be at a logic level "H". 2*f* is defined by allowing the field signal f2 to be at a logic level "H". 3*f* is defined by allowing the field signal f3 to be at a logic level "H". 4*f* is defined by allowing the field signal f4 to be at a logic level "H".

D1 indicates the display pattern in the first line corresponding to the simultaneously selected three scan electrodes. D2 indicates the display pattern in the second line corresponding to the simultaneously selected three scan electrodes. D3 indicates the display pattern in the third line corresponding to the three scan electrodes.

According to this truth table, the following decode functions can be realized. In the case where the field signal f1 is "H", if the display patterns D1 to D3 are (1,0,0), MLS operation results 412 by the orthogonal functions shown in FIG. 4 are obtained by using the dummy pattern 410 (ON (−1)) corresponding to the display pattern (ON (−1), OFF (1), OFF (1)) in FIG. 9. Therefore, a logic level "L" is output as the decoded output OUT in 1*f* so that the voltage level MV1 corresponding to the voltage level "−2" shown in FIG. 9 is output.

Grayscale display can be realized by providing the decoder circuits having the same decoding functions for respective bits of the grayscale data. In this embodiment, the ROMs 300, 302, 304, and 306 output the decode results according to the above truth table.

As described above, the decoder circuits which output the decoded output signals corresponding to the fields from the 4MLS operation results based on the scan pattern for the simultaneously selected three scan electrodes and the display patterns of the signal electrode for three lines are provided in units of bits. Therefore, 3MLS can be realized without generating a dummy display pattern corresponding to the virtual electrode or the like. Moreover, the voltage levels necessary for driving the signal electrode can be binarized in 3MLS, and contrast equal to 4MLS can be realized. Furthermore, since it is unnecessary to perform the MLS operations, the configuration can be significantly simplified.

2.2 Pulse Width Modulation

As described above, the display driver circuit of this embodiment latches the MLS operation results decoded and output from the ROMs 300, 302, 304, and 306 by the fourth line memory 316, modulates pulse width of the MLS operation results, and outputs the MLS operation results to the signal electrode.

In this embodiment, the signal of the decoded and output MLS operation results is pulse width modulated by using the coincidence detection circuit 318. The coincidence detection circuit 318 changes the pulse width based on the coincidence detection results between the signal of the decoded and output MLS operation results and the count value counted by a clock for pulse width clocking. The signal of the MLS operation results is supplied to the coincidence detection circuit 318 as a PWM change point setting signal.

Figure 11:
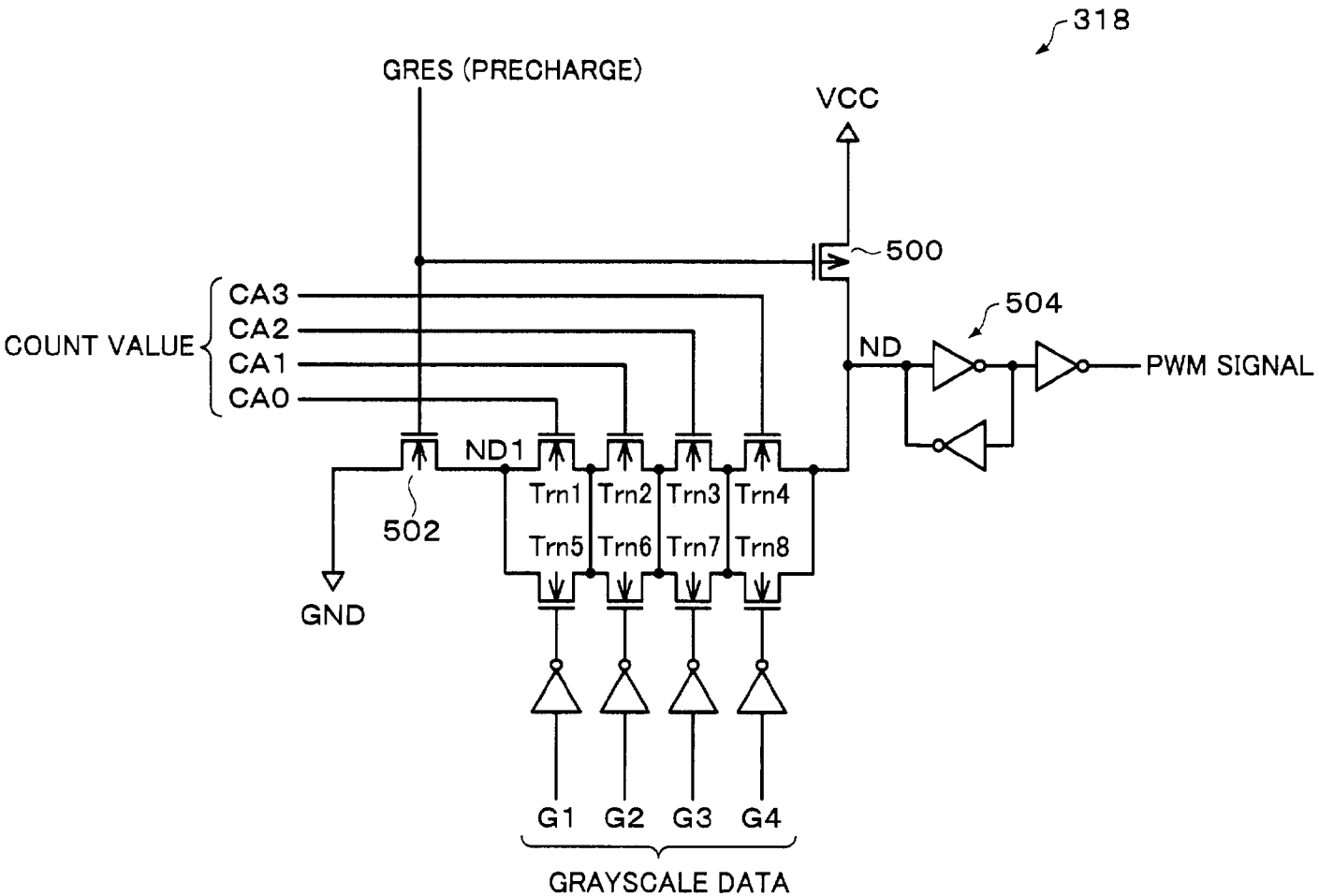
FIG. 11 is a circuit diagram showing a configuration of a coincidence detection circuit.

FIG. 11 shows an example of a configuration of the coincidence detection circuit 318.

Each bit CA0 to CA3 (CA0 is LSB) of the count value to be counted by a clock GCP for pulse width clocking and each bit G1 to G4 of the MLS operation results are input to the coincidence detection circuit 318. The PWM signal is changed based on the coincidence detection results.

The coincidence detection circuit 318 includes a p-type MOS transistor (switching element in a broad sense) 500 with which a power supply voltage level VCC is connected at a source terminal. A reset signal GRES as a precharge signal is applied (supplied) to a gate electrode of the p-type MOS transistor 500. An output node ND is connected with a drain terminal of the p-type MOS transistor 500. As the reset signal GRES, a latch pulse LP which is changed corresponding to one horizontal scan period may be used.

The coincidence detection circuit 318 includes an n-type MOS transistor 502 with which a ground voltage level GND is connected at a source terminal. The reset signal GRES is applied to a gate electrode of the n-type MOS transistor 502. A node ND1 is connected with a drain terminal of the n-type MOS transistor 502.

First to fourth n-type MOS transistors (Trn1 to Trn4) connected in series and fifth to eighth n-type MOS transistors (Trn5 to Trn8) connected in series are inserted between the output node ND and the node ND1. A drain terminal and a source terminal of the Trn1 are respectively connected with a drain terminal and a source terminal of the Trn5. A drain terminal and a source terminal of the Trn2 are respectively connected with a drain terminal and a source terminal of the Trn6. A drain terminal and a source terminal of the Trn3 are respectively connected with a drain terminal and a source terminal of the Trn7. A drain terminal and a source terminal of the Trn4 are respectively connected with a drain terminal and a source terminal of the Trn8.

Signals of each bit CA0 to CA3 of the count value are applied to gate electrodes of the Trn1 to Trn4. Each bit G1 to G4 of the MLS operation results (decoded output signal in a broad sense) are inverted and applied to gate electrodes of the Trn5 to Trn8.

A latch circuit 504 is connected with the output node ND. The latch circuit 504 outputs the PWM signal corresponding to the logic level of the output node ND.

Figure 12:
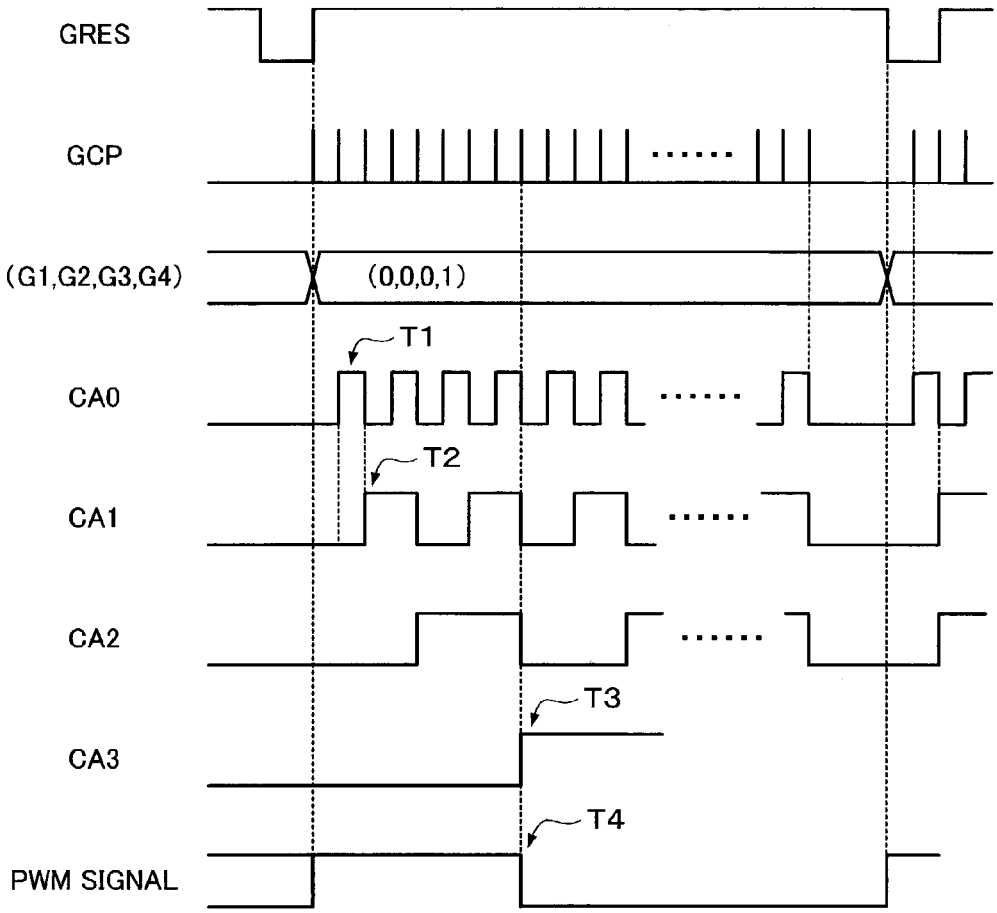
FIG. 12 is a timing chart showing operation timing of the coincidence detection circuit.

FIG. 12 shows an example of a timing chart of the coincidence detection circuit 318.

The reset signal GRES is a pulse which is changed to a logic level "L" in a field cycle, for example. When the logic level of the reset signal GRES is "L", the output node ND is at the power supply voltage level VCC through the p-type MOS transistor 500, whereby the logic level of the output node ND is held by the latch circuit 504. At this time, the logic level of the PWM signal becomes "H". The n-type MOS transistor 502 is turned OFF. A counter (not shown) is reset by the reset signal GRES in a period in which the output node ND is precharged, whereby the count value becomes "0". The counter counts the 4-bit counter value in synchronization with the clock GCP. The counter value is applied to the gate electrodes of the Trn1 to Trn4 as the signals CA0 to CA3.

When the logic level of the reset signal GRES becomes "H", the p-type MOS transistor 500 is turned OFF and the n-type MOS transistor 502 is turned ON. Therefore, the node ND1 is at the ground voltage level. The output node ND is held at the logic level "H".

The output node ND and the node ND1 are electrically connected when one of the Trn1 and Trn5 is turned ON, one of the Trn2 and Trn6 is turned ON, one of the Trn3 and Trn7 is turned ON, and one of the Trn4 and Trn8 is turned ON.

In the case where the grayscale data is "8" ((G1,G2,G3, G4)= (0,0,0,1)), the Trn5 to Trn7 are turned ON and only the Trn8 is turned OFF. If the LSB is the bit CA0 among the bits CA0 to CA3 of the count value, the bit CA1 becomes "1" when the count value is "1" (T1), whereby only the Trn1 is turned ON and the Trn2 to Trn4 are turned OFF. Since only the bit CA2 becomes "1" when the count value becomes "2" (T2), only the Trn2 is turned ON and the Trn1, Trn3, and Trn4 are turned OFF. The Trn4 is turned ON when the bit CA3 becomes "1" (T3), whereby the output node ND and the node ND1 are electrically connected. Specifically, the output node ND and the node ND1 are electrically connected at the eighth clock GCP. This allows the output node ND to be at the ground voltage level, whereby the PWM signal is changed to the logic level "L" (T4). This state is maintained by the latch circuit 504 until the output node ND is precharged, even if the count value is increased.

FIGS. 13A to 13F show examples of the segment waveforms in the case of realizing 16 grayscale display by using PWM in the display driver circuit of this embodiment.

ON and OFF states of the display pattern are respectively indicated by "1" and "0". "1" and "−1" of the segment waveform respectively indicate "V1" and "MV1".

Figure 13A:
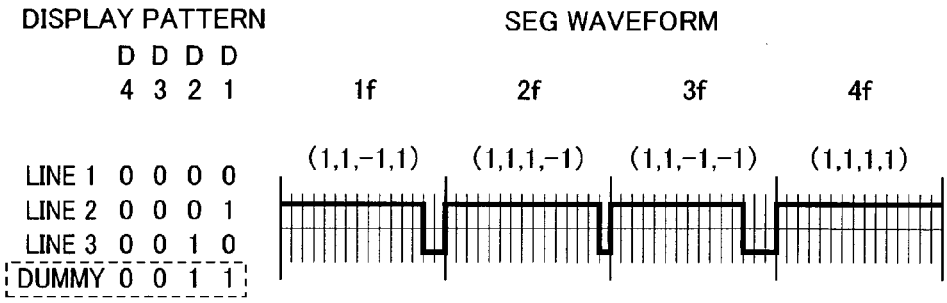
FIGS. 13A to 13F are waveform diagrams showing examples of segment waveforms in the case of realizing 16-grayscale display in the display driver circuit of this embodiment by using PWM.
Figure 13B:
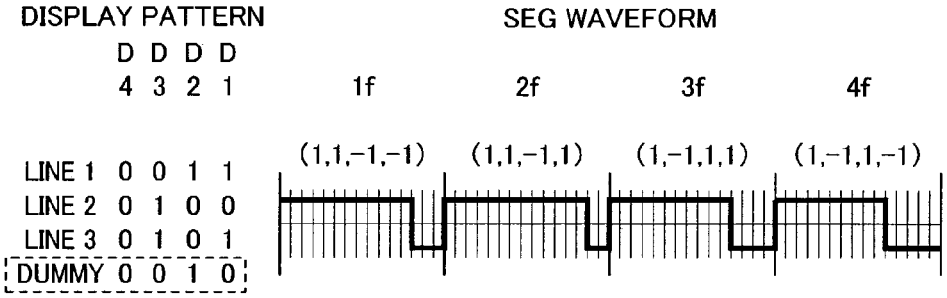
Figure 13C:
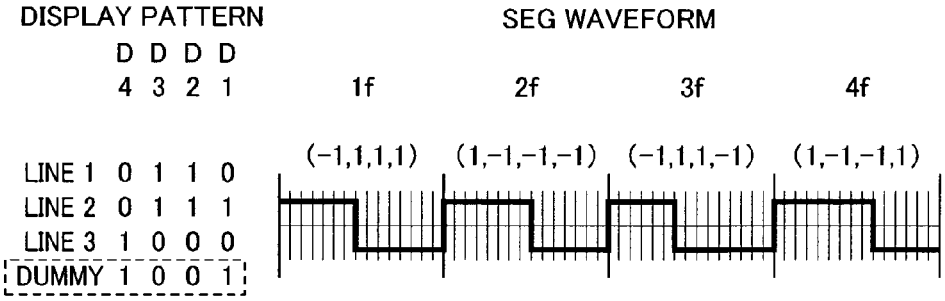
Figure 13D:
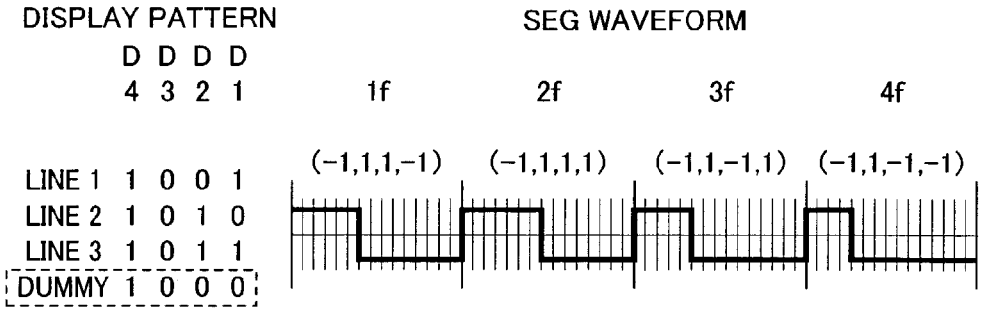
Figure 13E:
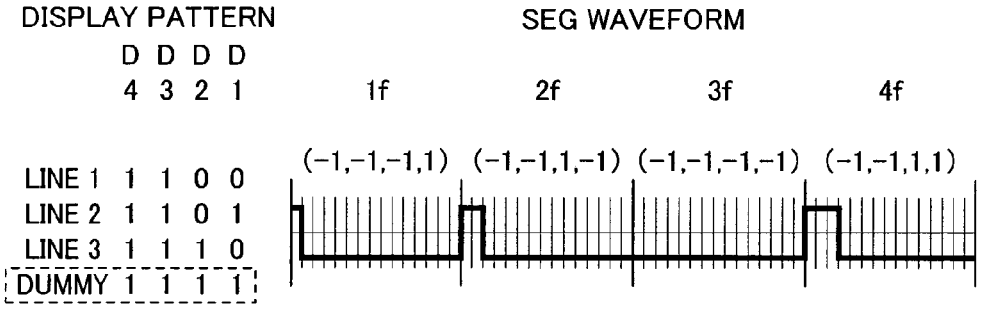
Figure 13F:
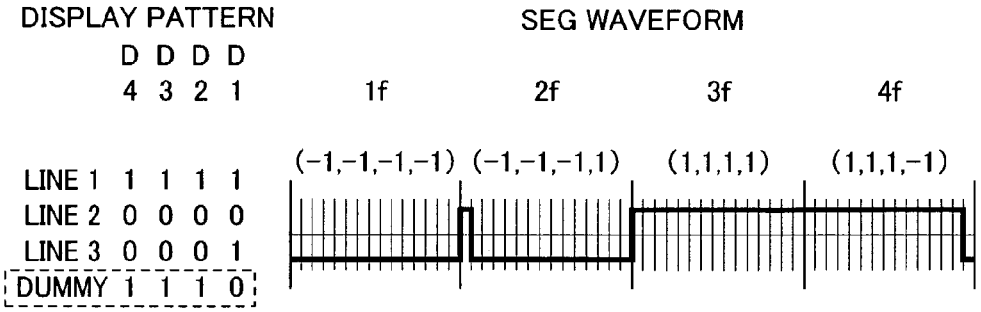

In the display pattern shown in FIG. 13B, when the MLS operation results become (1,1,−1,−1) (=12) in 1*f*, the logic level of the PWM signal is changed to "L" at the twelfth segment. In FIG. 13E, when the MLS operation results become (−1,−1,1,1) (=3) in 4*f*, the logic level of the PWM signal is changed to "L" at the third segment.

The coincidence detection circuit 318 performs the coincidence detection between each bit of the grayscale data and the count value to be counted. The configuration of the coincidence detection circuit 318 is not limited to that shown in FIG. 11. The coincidence detection circuit 318 may not only perform the coincidence detection between each bit of the grayscale data and the count value, but also detect whether or not each bit of the grayscale data and the count value is in a complementary state.

Since the voltage level of the segment waveform consists of two values, shift of the segment waveform to the right or the left can be easily realized. As a result, deterioration of the liquid crystal due to application of a DC component can be prevented, and the influence of crosstalk can be easily reduced.

2.3 Detailed Configuration Example of Display Driver Circuit

A detailed configuration example of the display driver circuit including the MLS decoder and the coincidence detection circuit is described below.

Figure 14:
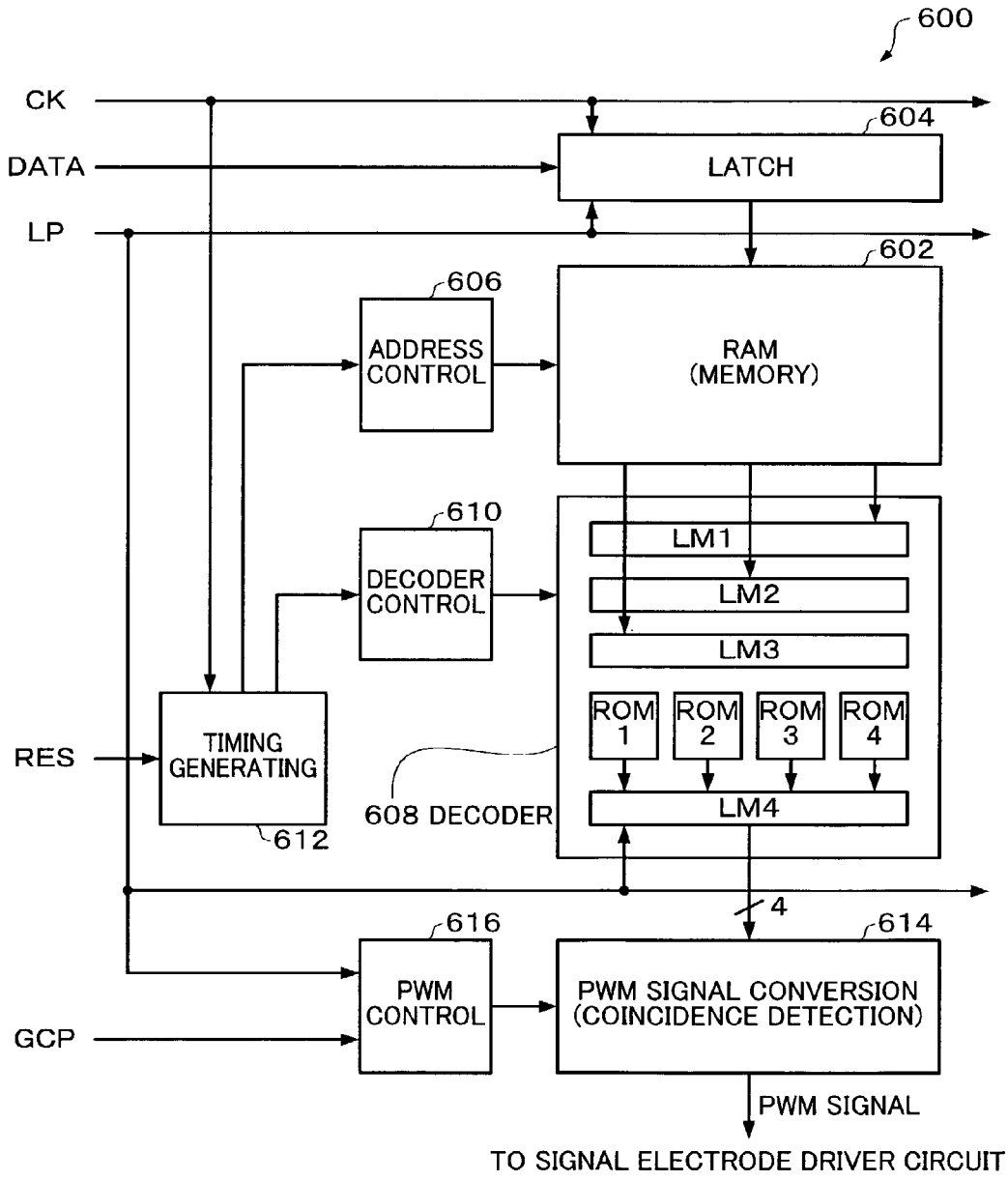
FIG. 14 is a block diagram showing a detailed configuration example of the display driver circuit of this embodiment.

FIG. 14 shows a detailed configuration example of the display driver circuit in this embodiment.

A display driver circuit 600 may be applied as the signal driver 204 of the electro-optical device 200 shown in FIG. 1. FIG. 14 shows only a block diagram corresponding to one bit of output in order to simplify the description.

The display driver circuit 600 includes a RAM 602 which stores one frame of grayscale data, for example.

The display driver circuit 600 includes a latch 604. The latch 604 has a function of a data capturing circuit for writing the grayscale data into the RAM 602 and a function of a line latch. A clock CK for capturing the grayscale data, grayscale data DATA, and a latch pulse LP are input to the latch 604.

An address control circuit 606 controls writing of the grayscale data output from the latch 604 into the RAM 602 or controls reading of the grayscale data from the RAM 602.

The grayscale data read from the RAM 602 is supplied to a decoder circuit 608. As the decoder circuit 608, the circuit shown in FIG. 2 may be employed, for example. In this case, the decoder circuit 608 includes first to fourth line memories LM1 to LM4, and ROM1 to ROM4 which are provided in units of bits of the grayscale data and output the decoded data according to the truth table shown in FIG. 10. The decoder circuit 608 is controlled by a decoder control circuit 610. In more detail, the decoder control circuit 610 supplies the field signal shown in FIG. 2 in response to the field display timing.

In the decoder circuit 608, the first to third line memories LM1 to LM3 may be omitted by assigning the functions of the first to third line memories LM1 to LM3 to the RAM 602. In the case where the delay of each bit at the time of PWM may be ignored, the fourth line memory LM4 may also be omitted. However, in the case where the delay of each bit during PWM cannot be ignored, coincidence detection of the pulse width prescribed by comparison with the count value to be counted may not coincide with the original timing. Therefore, it is preferable to make the delay between each bit uniform by allowing the fourth line memory LM4 to latch the decoded output.

The address control circuit 606 and the decoder control circuit 610 are controlled by a timing generating circuit 612. The timing generating circuit 612 specifies timing necessary for controlling reading or writing of the grayscale data and decode control timing of the grayscale data read from the RAM 602 by the field signals f1 to f4 (or field setting signals F1 and F2) corresponding to the display timing, by using the clock CK and the reset signal RES.

The decoded output of the decoder circuit 608 is supplied to a PWM signal conversion circuit 614. As the PWM signal conversion circuit 614, the coincidence detection circuit shown in FIG. 11 may be employed. The PWM signal conversion circuit 614 is controlled by a PWM control circuit 616. The PWM control circuit 616 generates the count values CA0 to CA3 of the counter by using the clock GCP for pulse width clocking and controls the coincidence detection by using the latch pulse LP corresponding to the horizontal scan period as the reset signal GRES, for example.

The PWM signals having the segment waveforms shown in FIGS. 13A to 13F can be generated by this configuration, for example.

3. Modification Example

The PWM signal generated by the PWM signal conversion circuit becomes a pulse signal which is clocked at an equal width by the clock GCP for pulse width clocking.

Figure 15:
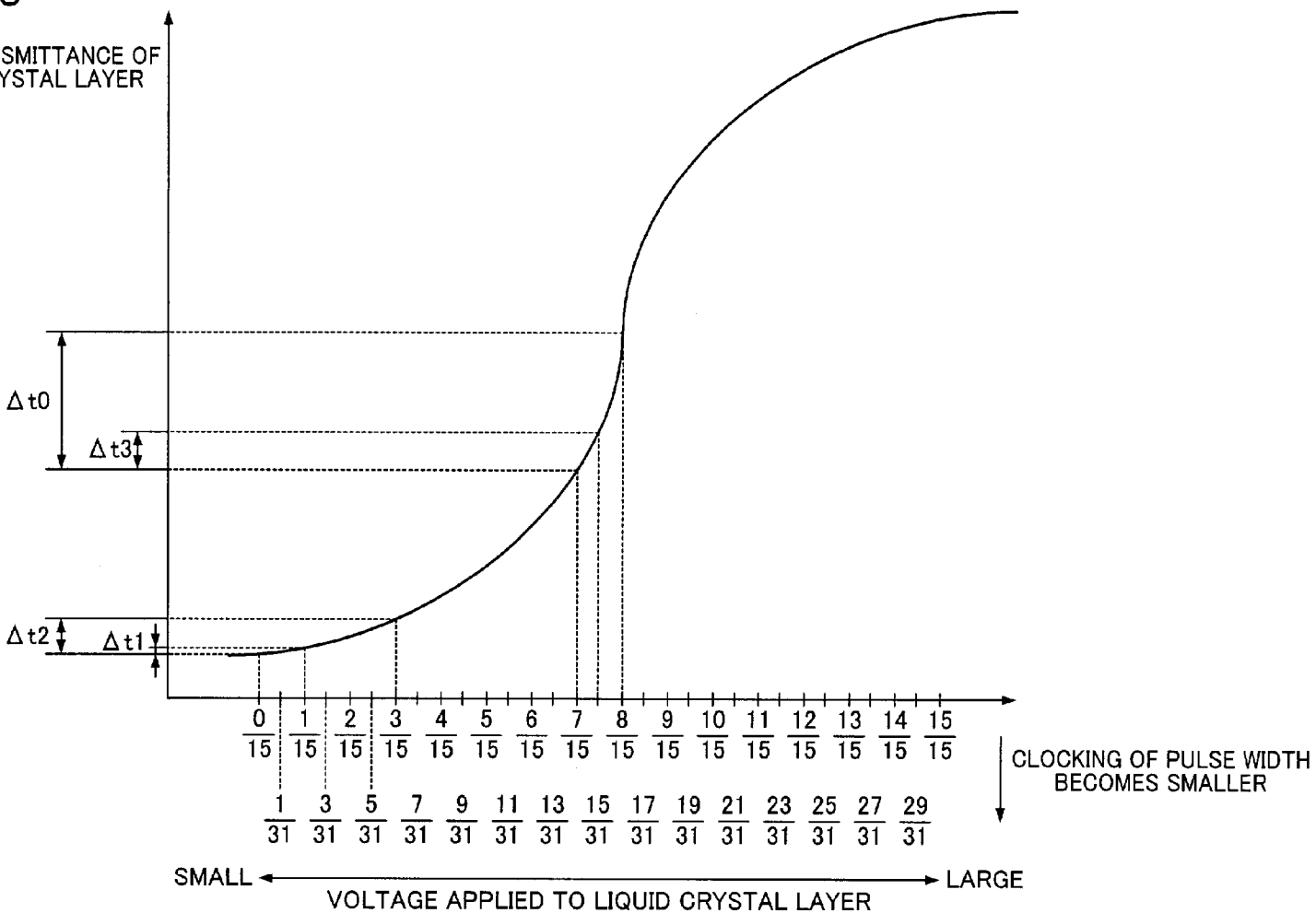
FIG. 15 shows an example of the relation between light transmittance of the liquid crystal layer which determines grayscale display characteristics and the PWM pulse width.

FIG. 15 shows an example of the relation between light transmittance of the liquid crystal layer which determines grayscale display characteristics and the PWM pulse width.

The vertical axis indicates the light transmittance of the liquid crystal layer, and the horizontal axis indicates the PWM pulse width. The voltage (root-mean-square value) applied to the liquid crystal layer is increased as the pulse width is increased.

The light transmittance of the liquid crystal layer has properties in which the change rate is maximum near the center value between the applied voltage corresponding to a pulse width "0/15" and the applied voltage corresponding to a pulse width "15/15", and the change rate is minimum on each end. Therefore, a change Δt0 of the light transmittance between the pulse width "7/15" and the pulse width "8/15" between which the difference is "1/15" is greater than a change Δt1 of the light transmittance between the pulse width "0/15" and the pulse width "1/15" between which the difference is also "1/15", for example. This means that adjustment for enabling optimum grayscale display of the liquid crystal panel for the eyes of the viewer is difficult.

In this modification example, the difference in change of the light transmittance at each point is decreased as much as possible by decreasing the width of PWM (dividing into 31 segments, for example) . In this modification example, m bits (four bits, for example) of grayscale data is converted into (m+p) (p is a natural number) bits (five bits, for example) of grayscale data. In this case, specific grayscale data is detected and converted into grayscale data corrected so that the light transmittance is optimum for the eyes of the viewer.

For example, four bits of grayscale data corresponding to the pulse width "0/15" is converted into five bits of grayscale data corresponding to the pulse width "0/31". Or, four bits of grayscale data corresponding to the pulse width "1/15" is converted into five bits of grayscale data corresponding to the pulse width "6/31". Since the grayscale data can be converted into optional grayscale data by changing the number of bits, optimum grayscale display can be realized by decreasing the difference in change (Δt2, Δt3) of the light transmittance. If the PWM width is decreased, the number of bits of the grayscale data to be pulse width modulated is increased. However, according to this modification example, optimum light transmittance for the eyes of the viewer can be easily obtained while preventing an increase in the circuit scale.

Figure 16:
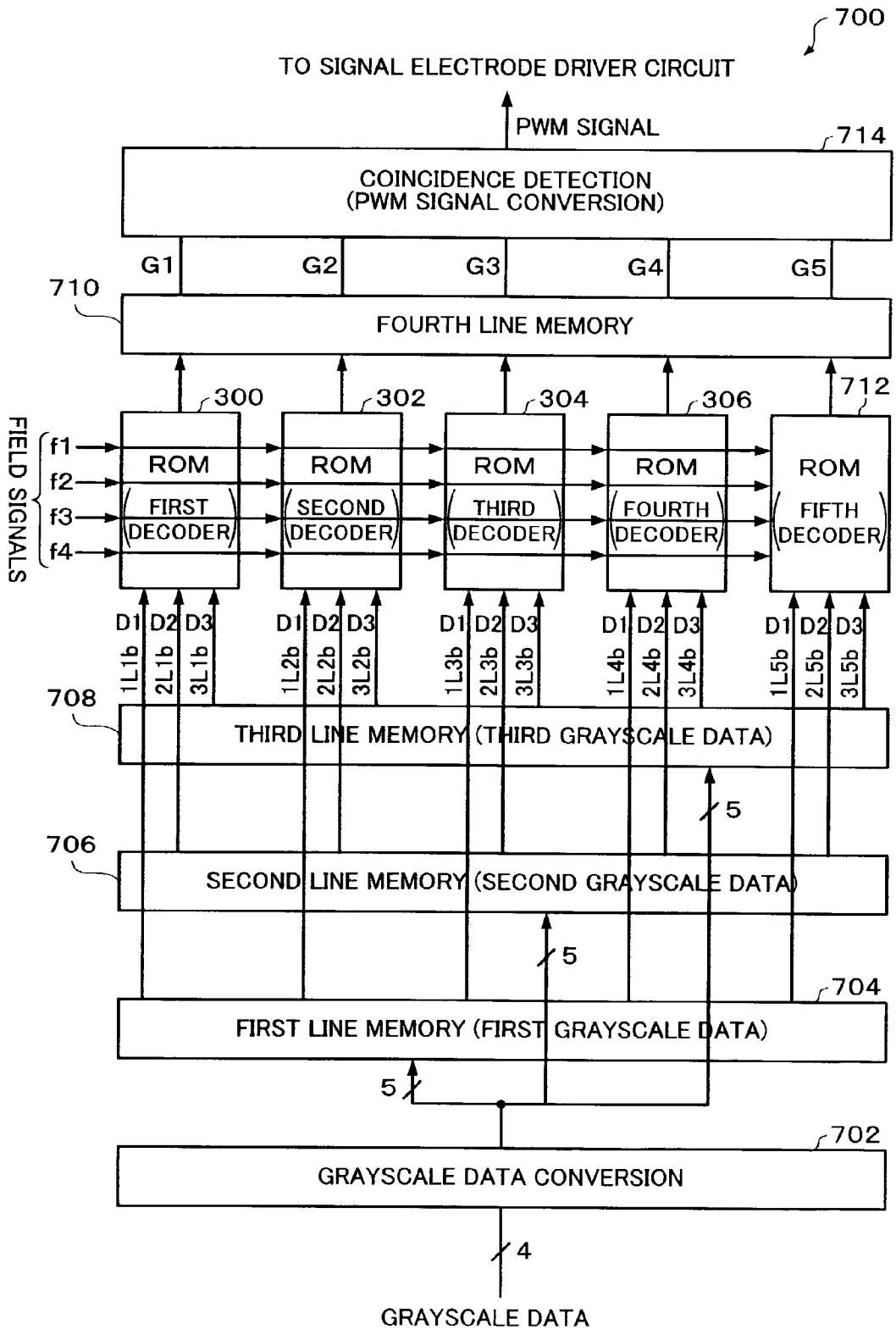
FIG. 16 is a block diagram showing a feature of a configuration of a display driver circuit including an MLS decoder in a modification example.

FIG. 16 shows a feature of a configuration of the display driver circuit including the MLS decoder in this modification example.

A display driver circuit 700 in this modification example includes a grayscale data conversion circuit 702 which converts m (m=4 in FIG. 2) bits of grayscale data to be decoded into (m+p) bits of grayscale data, for example. Since the above-described MLS decoder includes the decoder circuits in units of bits of the grayscale data, it suffices that decoder circuits having the same configuration be provided for an increase in the number of bits (p bits) of the grayscale data converted by the grayscale data conversion circuit.

A case where four (m=4) bits of grayscale data is converted into five (p=1) bits of grayscale data is described below.

The display driver circuit 700 in this modification example may be realized by a configuration substantially the same as that of the display driver circuit shown in FIG. 2. However, the display driver circuit 700 differs from the display driver circuit shown in FIG. 2 in the following features.

The first feature is that first to fourth line memories 704, 706, 708, and 710 have a width of five bits. Grayscale data converted into a width of five bits by the grayscale data conversion circuit 702 is held in the first to third line memories 704, 706, and 708.

The second feature is that the display driver circuit 700 includes a ROM 712 for one additional bit. This enables the MLS operation results to be decoded and output for five bits of grayscale data. The five bits of MLS operation results are latched by the fourth line memory 710. The ROM 712 has the same configuration as the ROMs 300, 302, 304, and 306.

The third feature is that a PWM signal conversion circuit 714 modulates pulse width of the five bits of grayscale data. As the PWM signal conversion circuit 714, the coincidence detection circuit shown in FIG. 11 may be employed. In this case, the number of n-type MOS transistors connected in series between the output node ND and the node ND1 is five. Five bits of count value and five bits of grayscale data are supplied to each of the n-type MOS transistors.

In the case where the display driver circuit includes a display data RAM which stores the grayscale data, the display data RAM may be allowed to have the same functions as the first to third line memories 704, 706, and 708.

Figure 17:
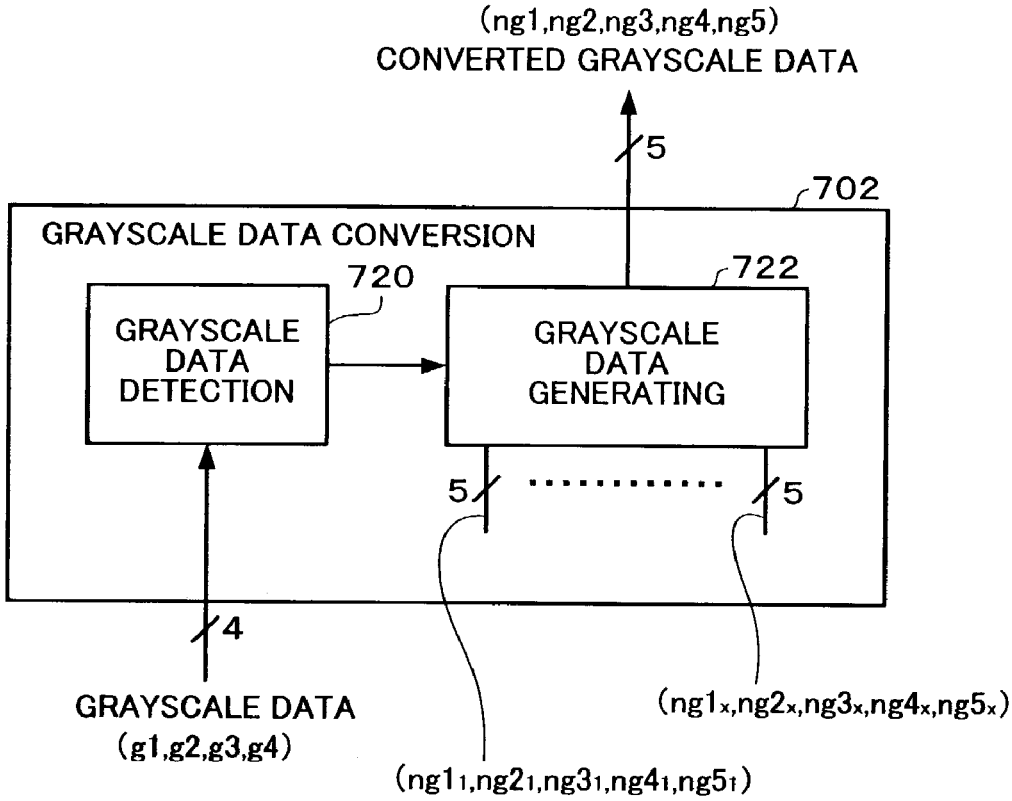
FIG. 17 is a block diagram showing an outline of a configuration of a grayscale data conversion circuit of the modification example.

FIG. 17 shows an outline of a configuration of the grayscale data conversion circuit 702.

The grayscale data conversion circuit 702 includes a grayscale data detection circuit 720 and a grayscale data generating circuit 722.

The grayscale data detection circuit 720 detects four bits (m bits) of grayscale data to be corrected for optimizing grayscale display. The grayscale data generating circuit 722 generates five bits ((m+p) bits) of grayscale data in which evaluation results for display characteristics are reflected in advance instead of the grayscale data to be corrected which is detected by the grayscale data detection circuit 720.

In the case where four bits of grayscale data (g1,g2,g3,g4) is input, for example, the grayscale data detection circuit 720 detects whether or not the input grayscale data is specific grayscale data (GG1,GG2,GG3,GG4). The grayscale data detection circuit 720 outputs one of a plurality of five bits of grayscale data ($ng1_1$,$ng2_1$,$ng3_1$,$ng4_1$,$ng5_1$) to ($ng1_x$,$ng2_x$,$ng3_x$,$ng4_x$,$ng5_x$) as five bits of converted grayscale data (ng1,ng2,ng3,ng4,ng5) according to the detection results. For example, when specific grayscale data in which the pulse width becomes "7/15" is detected, the grayscale data detection circuit 720 outputs five bits of grayscale data in which the pulse width becomes "13/31" so that the grayscale characteristics are corrected. When the specific grayscale data is not detected, the grayscale data detection circuit 720 outputs five bits of grayscale data in which the pulse width becomes "14/31".

The grayscale data conversion circuit 702 having such a function may be realized by using a combinational circuit.

As described above, optimum grayscale display for the eyes of the viewer can be realized using an extremely simple configuration by increasing the number of bits of the grayscale data by providing the grayscale data conversion circuit.

In the case of applying this modification example to the display driver circuit shown in FIG. 14, the grayscale data conversion circuit may be provided between the latch 604 and the RAM 602, or the configuration shown in FIG. 16 may be provided in the area of the decoder circuit 608. In the case of increasing the number of bits of the grayscale data read from the RAM 602 by using the grayscale data conversion circuit, it is unnecessary to increase the capacity of the RAM 602.

The display driver circuit to which this modification example is applied may be employed as the signal driver of the electro-optical device shown in FIG. 1.

The present invention is not limited to the above embodiment. Various modifications and variations are possible.

As electronic equipment to which the above electro-optical device is applied, equipment for which a decrease in power consumption is strongly demanded such as a pager, watch, and a personal data assistant (PDA) is suitable in addition to the above-described portable telephone. Moreover, the electro-optical device can also be applied to a liquid crystal TV, view finder type or direct-view monitor type video tape recorder, car navigation system, calculator, word processor, workstation, videophone, POS terminal, equipment provided with a touch panel, and the like.

In this embodiment and the modification example, 3MLS is described. However, the present invention is not limited by the number of simultaneously selected lines.

This embodiment and the modification example are described mainly taking four bits of grayscale data as an example. However, the present invention is not limited by the number of bits of grayscale data. In this modification example, the number of additional bits is one bit. However, the present invention is not limited by the number of additional bits.

What is claimed is:

1. A display driver circuit which drives an electro-optical device having scan electrodes and signal electrodes by using a multi-line selection that selects three scan electrodes simultaneously, the display driver circuit comprising:

first to m-tb (m is a natural number) decoder circuits which are provided for respective bits of each of first to third grayscale data and output decoded output signals based on a field signal and the respective bits of each of the first to third grayscale data, the first to third grayscale data being m-bit data and corresponding to a scan pattern of the three scan electrodes;

a pulse width modulation signal conversion circuit which modulates pulse width of m bits of the decoded output signals output from the first to m-th decoder circuits; and a signal electrode driver circuit which drives the signal electrode based on signals, pulse width of which is modulated by the pulse width modulation signal conversion circuit, wherein an i-th (i is a natural number equal to or greater than one and equal to or less than m) decoder circuit outputs one of the decoded output signals corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes, the display pattern being corresponding the i-bit data of the first to third grayscale data; and wherein the signal electrode driver circuit drives the signal electrode by using one of two potential levels based on the signals, pulse width of which is modulated by the pulse width modulation signal conversion circuit.

2. A display driver circuit which drives an electro-optical device having scan electrodes and signal electrodes by using a multi-line selection that selects three scan electrodes simultaneously, the display driver circuit comprising:

a grayscale data conversion circuit which converts m (m is a natural number) bits of first to third grayscale data corresponding to scan pattern of the three scan electrodes into (m+p) bits (p is a natural number) of first to third converted grayscale data, respectively;

first to (m=p)th decoder circuits which are provided for respective bits of each of the first to third converted grayscale data and output decoded output signals based on a field signal end respective bits of each of the first to third converted grayscale data;

a pulse width modulation signal conversion circuit which modulates pulse width of (m+p) bits of the decoded output signals output from the first to (m+p)th decoder circuits; and a signal electrode driver circuit which drives the signal electrode based on signals, pulse width of which is modulated by the pulse width modulation signal conversion circuit, wherein a j-th (j is a natural number equal to or greater than one and equal to or less than (m+p)) decoder circuit outputs one of the decoded output signals corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes, the display pattern being corresponding to the j-th bit data of the first to third grayscale data; and wherein the signal electrode driver circuit drives the signal electrode by using one of two potential levels based on the signals, pulse width of which is modulated by the pulse width modulation signal conversion circuit.

3. An electro-optical device which is driven by using a multi-line selection that selects three scan electrodes simultaneously, the electro-optical device comprising:

a pixel defined by one of a plurality of scan electrodes and one of a plurality of signal electrodes intersecting each other;

the display driver circuit as defined by claim 1 which drives the signal electrode; and a scan driver which drives the scan electrodes.

4. An electro-optical device which is driven by using a multi-line selection that selects three scan electrodes simultaneously, the electro-optical device comprising:

a pixel defined by one of a plurality of scan electrodes and one of a plurality of signal electrodes intersecting each other;

the display driver circuit as defined by claim 2 which drives the signal electrode; and a scan driver which drives the scan electrodes.

5. An electro-optical device which is driven by using a multi-line selection that selects three scan electrodes simultaneously, the electro-optical device comprising:

a display panel having a pixel defined by one of a plurality of scan electrodes and one of a plurality of signal electrodes intersecting each other;

the display driver circuit as defined by claim 1 which drives the signal electrode; and a scan driver which drives the scan electrodes.

6. An electro-optical device which is driven by using a multi-line selection that selects three scan electrodes simultaneously, the electro-optical device comprising:

a display panel having a pixel defined by one of a plurality of scan electrodes and one of a plurality of signal electrodes intersecting each other the display driver circuit as defined by claim 2 which drives the signal electrode; and a scan driver which drives the scan electrodes.

7. A display drive method of driving an electro-optical device having scan electrodes and signal electrodes by using a multi-line selection that selects three scan electrodes simultaneously, the method comprising:

outputting decoded output signals for respective bits of each of first to third grayscale data, based on a field signal and ani-th data of the first to third grayscale data, the first to third grayscale data being m-bit (m is a natural number and i is a natural number equal to or greater than one and equal to or less than m) data and corresponding to a scan pattern of the three scan electrodes; and driving the signal electrode by using one of two potential levels based on the signals, pulse width of which is modulated based on the decoded output signals, wherein the i-th bit data of the decoded output signals is output corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes, the display pattern being corresponding to i-th bit data of the first to third grayscale data.

8. A display drive method of driving an electro-optical device having scan electrodes and signal electrodes by using a multi-line selection that selects three scan electrodes simultaneously, the method comprising:

converting m (m is a natural number) bits of first to third grayscale data corresponding to scan pattern of the three scan electrodes into (m+p) bits (p is a natural number) of first to third converted grayscale data, respectively;

outputting decoded output signals for respective bits of each of the first to third converted grayscale data, based on a field signal and a j-th bit data of the first to third converted grayscale data (j is a natural number equal to or greater than one and equal to or less than (m+p)); and driving the signal electrode by using one of two potential levels based on the signals, pulse width of which is modulated based on the decoded output signals, wherein j-th bit data of the decoded output signals is output corresponding to the field signal, by using a result of a given operation executed on a display pattern and a dummy pattern corresponding to the display pattern, based on an orthogonal function which defines the scan pattern of the three scan electrodes in each field and a scan pattern of a virtual scan electrode corresponding to the scan pattern of the three scan electrodes, the display pattern being corresponding to j-th bit data of the first to third grayscale data.

* * * * *